US012599278B1

(12) United States Patent
Feeny et al.

(10) Patent No.: US 12,599,278 B1
(45) Date of Patent: Apr. 14, 2026

(54) ROTARY FLOOR BUFFING PAD WITH AGITATOR INSERT

(71) Applicant: The Tuway American Group, Inc., Troy, MI (US)

(72) Inventors: John Feeny, Troy, MI (US); Douglas Koester, Troy, MI (US)

(73) Assignee: The Tuway American Group, Inc., Troy, MI (US)

( * ) Notice: Subject to any disclaimer, the term of this patent is extended or adjusted under 35 U.S.C. 154(b) by 665 days.

(21) Appl. No.: 17/481,217

(22) Filed: Sep. 21, 2021

Related U.S. Application Data

(60) Provisional application No. 63/138,494, filed on Jan. 17, 2021, provisional application No. 63/081,247, filed on Sep. 21, 2020.

(51) Int. Cl.
*A47L 11/164* (2006.01)
*A47L 11/162* (2006.01)
*A47L 11/283* (2006.01)

(52) U.S. Cl.
CPC ..... *A47L 11/164* (2013.01); *A47L 11/162* (2013.01); *A47L 11/283* (2013.01)

(58) Field of Classification Search
CPC ..... A47L 11/283; A47L 11/162; A47L 11/164
See application file for complete search history.

(56) References Cited

U.S. PATENT DOCUMENTS 5,249,325 A * 10/1993 Wilen ..... A47L 11/164 15/50.1
6,088,871 A * 7/2000 Kobayashi ..... A47L 13/16 15/228
2014/0311695 A1* 10/2014 Clark ..... D21H 13/20 162/146
2017/0129067 A1* 5/2017 Young ..... B24B 7/186
2018/0235425 A1* 8/2018 Ding ..... A47L 11/282

FOREIGN PATENT DOCUMENTS

WO WO-03045135 A2 * 6/2003 ..... A01K 13/001

OTHER PUBLICATIONS

WO 03045135 A2 (machine translation) (Year: 2003).*
Tuway Advertisement, Manufacturing quality products since 1923, The Polar Pad—A Virtually Dustless Floor Pad, 1 page.

* cited by examiner

*Primary Examiner* — Andrew A Horton
(74) *Attorney, Agent, or Firm* — Young Basile Hanlon & MacFarlane, P.C.

(57) ABSTRACT

A floor cleaning/refurbishment pad that includes a support layer, the support layer having a central region and an outer peripheral edge defining an outer support layer dimension, a loft material layer overlaying the support material layer and connected thereto, the loft material composed of at least one loft material and the microfiber loft material layer having a height $H_L$ and an outwardly facing surface and an agitator/abrasive strip overlaying a portion of the support material layer and connected thereto, the agitator strip having a height $H_A$ and an outwardly facing surface.

10 Claims, 21 Drawing Sheets

ROTARY FLOOR BUFFING PAD WITH AGITATOR INSERT

The present application claims priority to U.S. Ser. No. 63/081,247 filed Sep. 21, 2020, and U.S. Ser. No. 63/138,494 filed Jan. 17, 2021, the specification of which is incorporated in its entirety herein.

BACKGROUND

This application pertains to floor pads used to clean surface floors that have a buffing action. More particularly, the present application pertains to floor pad used to clean and/or buff floors that are used with super or high-speed flooring machines which rotate or oscillate to accomplish some or all of the desired cleaning and/or buffing action.

Various floor pad configurations have been proposed for floor cleaning and buffing operations accomplished by floor cleaning machines. Floor cleaning machines can be configured to impart an oscillating or rotating action to a suitably configured floor cleaning pad that accomplishes cleaning and/or polishing and/or polishing action. Floor cleaning machines can be configured to provide pad revolution speed greater than 175 rpm or the equivalent oscillation speed. Floor cleaning machines can be configured to achieve pad revolution speed to values up to an including 2000 rpm or the equivalent oscillation speed and higher.

The high speeds employed by floor cleaning machines can impart significant shear and/or centrifugal forces that can cause deformation such as ovaling, shredding and the like. Additionally, the use of high-speed floor pads can generate dust and the like, particularly when used in burnishing applications.

Floor cleaning pads can be configured with a generally homogenous cleaning surface generally chosen for the cleaning and burnishing requirements for the floor in general. This can cause difficulty in addressing areas of greater dirt loads or areas of greater contamination caused by spills, traffic, etc. Generally, cleaning operations in such areas require either precleaning or multiple passes using different leaning pads to address various cleaning issues. Additionally, deep cleaning and/or burnishing and/or floor restoration operations can generate dust and/or particulate matter that can become airborne. This can impede subsequent floor restoration and creating operations and can may create additional potential cleaning and even localized environmental issues.

It is desirable to provide a floor cleaning pad that can be employed clean and/or burnish floor and/or restore surfaces. It is desirable to provide a floor cleaning pad that can be employed clean and/or burnish floor and/or restore surfaces in a low-dust manner. It is also desirable to provide a floor cleaning pad that can accomplish floor cleaning and/or burnishing operations and/or floor restoration operations on a floor surfaces that have a variety of types of dirt or grime distributed on the surface thereon. It is also desirable to provide a floor cleaning pad that is durable and effective for high-speed cleaning applications.

SUMMARY

Disclosed is a floor cleaning pad that includes a support layer, the support layer having a central region and an outer peripheral edge. The floor cleaning pad also includes a microfiber loft material layer overlaying the support material layer and connected thereto. The microfiber loft material has a microfiber loft layer that is dimensioned less than or equal to the outer dimension defined by the support layer. The microfiber loft material layer has a height $H_L$ and an outwardly facing surface.

The floor cleaning pad also includes at least one agitator strip that overlies a portion of the support material layer and is connected thereto. The agitator strip has a height $H_A$ and an outwardly facing surface. The outwardly facing surface of the agitator strip is at an orientation planar with or indented relative to the outer face of the microfiber loft material layer.

Also disclosed is a floor cleaning assembly that includes a floor cleaning machine having a housing, at least one motor operatively mounted to the housing and at least one actuator operatively connected to the motor. The at least one actuator is configured to impart at least one of rotational movement, oscillating movement, rotational and oscillating movement to at least one output device. The output device has at least one attachment mechanism.

The floor cleaning assembly also includes a floor cleaning pad that is mounted to the attachment mechanism. The floor cleaning pad includes a support layer that has a central region and an outer peripheral edge defining an outer support layer dimension. The floor cleaning pad also includes a loft material layer that overlays the support material layer and connected thereto. The loft material layer has an outwardly oriented surface. The loft material present in the loft material is composed of at least one polymeric fiber loft material and the loft material layer having a height $H_L$. The floor cleaning pad also includes at least one agitator strip having an outwardly oriented surface and has a height $H_A$. The outwardly facing surface of the agitator strip is at an orientation planar with or indented relative to the outer face of the loft material layer and the support layer is releasably connected to the at least one attachment mechanism on the output device of the floor cleaning machine.

BRIEF DESCRIPTION OF THE DRAWINGS

The various features, advantages and other uses of the present apparatus will become more apparent by referring to the following detailed description and drawing in which.

DETAILED DESCRIPTION

Figure 1:
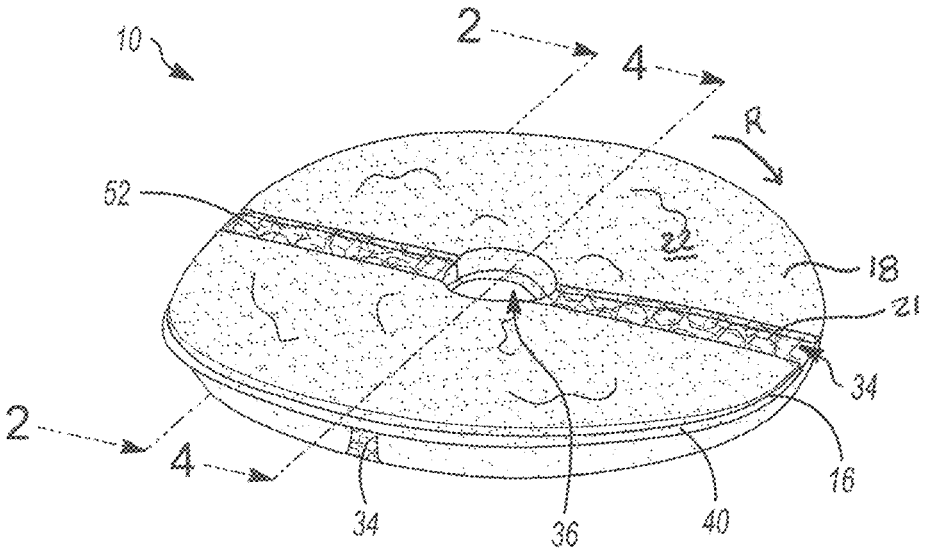
FIG. 1 is perspective view of a first embodiment of the floor cleaning pad as disclosed herein as viewed from the top surface.

Disclosed herein is a floor cleaning pad for use with various floor cleaning and/or burnishing machine. Among other advantages, the floor cleaning pad as disclosed herein, when employed with a suitable floor cleaning and/or burnishing machine can accomplish cleaning and/or polishing with increased dust and particulate accumulation in certain embodiments. The floor cleaning pad as disclosed herein can also accomplish enhanced cleaning operations in a variety of floor cleaning situations.

The floor cleaning pad as disclosed herein includes a support layer, a microfiber loft material layer and at least one agitator strip. As depicted in FIGS. 1, 5, 9 and 11, the floor cleaning pad 10, 10' includes at least one support layer 12. The at least one support layer 12, can have a central region 14 and an outer peripheral edge 16 that defines an outer support layer dimension D. The outer support layer dimension D defines the planar configuration of the floor cleaning pad 10, 10'.

The planar configuration of the floor cleaning pad 10,10' can be dimensioned to correspond to a desired high-speed floor cleaning machine. Non-limiting examples of such planar dimensions include circular floor cleaning pads 10, rectilinear floor cleaning pads 10' and the like. The desired high-speed floor cleaning machine can be one that can impart rotational movement, oscillating movement or a mixture of these movements. Non-limiting examples of such high-speed floor cleaning machines can include wet cleaning machines, dry cleaning machines and the like. These can include devices such as auto scrubbers, buffers and the like that can impart rotational movement to the floor cleaning pad 10,10' at speeds greater than 100 rpm. Other high-speed floor cleaning machines can include devices such as random oscillating orbital machines, floor burnisher machines and the like. It is contemplated that devices such as floor burnishing machines can impart speeds greater than 1000 rpm and, in some cases, speeds greater than 1500 to 2000 rpm to the floor cleaning pad being used while floor burnisher machines can impart speeds between 100 and 1750 orbits/minute to the associated cleaning pad.

The floor cleaning pad 10, 10' also includes at least one microfiber loft material layer 18 that overlays the support material layer 12 and is connected to the support material layer 12 either directly or indirectly. The microfiber loft material layer 18 will have a height $H_L$ that is sufficient to accomplish the desired cleaning or burnishing operations.

The microfiber loft material layer 18 can have an outwardly facing surface 20 and an inwardly oriented face 21. The outwardly facing surface 20 of the microfiber loft material layer 18 is disposed a spaced distance from the support material layer 14. The outwardly facing surface 20 can define a generally planar central region 22 that will contact the floor surface to be cleaned or burnished when the floor cleaning pad 10,10' is in a use position associated with a suitable floor cleaning machine.

The outwardly facing surface 20 also includes a peripheral region 24 that is located at the outer edge of the microfiber loft material layer 18. When the microfiber loft material layer 18 is in position on the support material layer 12, the peripheral region 24 is proximate to the outer peripheral edge 16 of the support material layer 12. In certain embodiments, the peripheral region 24 can define a curved surface when viewed in cross section relative to the generally planar central region 22. It is also contemplated that, where desired or required, the peripheral region 24 can define an angled surface relative to the generally planar central region 22.

In certain embodiments, the microfiber loft material layer 18 can have an initial height that is between 0.5 inches and 1.5 inches, with ranges between 0.5 and 0.75 inches in certain embodiments, when measured from the upper surface of the support layer 12 to the outwardly facing surface 20 of the generally planar central region 22. It is contemplated that the height $H_L$ of the microfiber loft material layer 18 can be reduced or compressed from the initial height as a result of continued use. In certain embodiments, the outwardly facing surface 20 defines at least a portion of the operative surface of the floor cleaning pad 10,10' when it is in the use position.

In certain embodiments, the microfiber loft material layer 18 can be composed of between 10 and 100% microfiber. In certain embodiments, the microfiber loft material layer 18 can be composed of between 30 and 100% microfiber; between 40 and 100% microfiber; between 50 and 100% microfiber; between 60 and 100% microfiber; between 70 and 100% microfiber; between 80 and 100% microfiber.

The microfiber that is employed can have microfibers having a size less that 0.7 denier. In certain embodiments it is contemplated that the microfibers will have an average size less than 0.7 denier. In certain embodiments, between 50 and 100% of the microfiber loft layer material layer 18 can be composed of microfibers having a size less than 0.7 denier; less than 0.6 denier; between 0.5 denier.

The microfiber content present in the microfiber loft material layer 18 can contain polymeric fibers. The polymeric material employed in the microfiber can be one or more of polyesters, polyamides, polyolefins, conjugates of polyesters and polyamides, conjugates of polyesters and polyolefins, conjugates of polyamides and polyolefins, conjugates of polyesters, polyamides and polyolefins, and the like. Non-limiting examples of suitable polyolefins include polyethylene, polypropylene and the like. In certain embodiments, the microfibers can be polyester.

In certain embodiments, the fiber material present in the microfiber loft material layer 18 can be randomly oriented in a lofty downlike manner.

In certain embodiments, the support layer 12 can be composed of a backing layer 26. The backing layer can be a woven backing layer, a non-woven backing layer or mixture of the two. The backing layer 26 can have a first surface 28, a second surface 30 opposed to the first surface 28. The backing layer 26 can have sufficient thickness to provide structure to the floor cleaning pad 10, 10'. In certain embodiments, the backing layer 26 can have a thickness between 0.1 inches and 2 inches. The backing layer 26 can be composed of any suitable material. In certain embodiments, the material employed in the backing layer 26 can be a suitable synthetic or natural material or mixture of the two that can provide sufficient support and dimensional stability to the floor cleaning pad 10, 10' particularly during one or more duty cycles. In certain embodiments, the support layer can be a woven synthetic fiber backing, a woven natural fiber backing, non-woven synthetic material, non-woven natural material, polymeric film and the like. Where desired or required, the backing material as well as the materials of construction for the various other components can be washable and reusable over various uses.

The support layer 12 can include a suitable polymeric foam layer such as polymeric foam layer 32. In certain embodiments, the polymeric foam layer will be interposed between the first surface 28 of the backing layer 26 and the microfiber loft material layer 18. Where desired or required, the inwardly oriented face 21 of the microfiber loft material layer 18 can be bonded to the polymeric foam layer 32 in any suitable manner.

The polymeric foam used in the polymeric foam layer 32 can be flexible thermoplastic or thermoset material and may be an open celled material. Non-limiting examples of suitable polymeric materials include polyurethanes, polypropylene, polyethylene and the like. In certain embodiments, the polymeric foam layer can be cut from polymeric foam slab stock. The polymeric foam layer can have a thickness between 0.4 and 0.75 inches with thicknesses between 0.5 and 0.75 in certain embodiments.

The floor cleaning pad 10, 10' also includes at least one agitator strip 34 that is positioned on the operative surface of the respective pad 10,10'. The at least one agitator strip overlays a portion of the support material layer and is connected thereto. Various non-limiting embodiments of the at least one agitator strip are depicted in the drawing figures as at reference numeral 34. In the various embodiments the at least one agitator strip 34 is configured as a rectilinear member. It is contemplated that agitator strip 34 can have any suitable configuration. Non-limiting examples of suitable shapes include pie shaped, sinusoidal and the like. In certain embodiments where the outer peripheral edge and associated microfiber loft material layer 18 are circular, it is contemplated that the at least one agitator strip 34 can be configured as an elongated strip that is oriented in a position that is generally perpendicular to the direction of rotational movement R of the floor cleaning pad 10 when in operational position on the associated cleaning machine. In certain embodiments, the agitator strip 34 can be rectilinear or can be pie-shaped with larger end portion located proximate either to the outer periphery or to the central region of the floor cleaning pad 10 as desired or required.

The agitator strip 34 can extend inward from the outer peripheral edge 16 defined by support layer 12 to a suitable internal point within a region defined in the respective floor cleaning pad 10, 10'. In certain embodiments, the agitator strip 34 can project though the body of the floor cleaning pad 10, 10' to extend from outer peripheral edge 16 to outer peripheral edge 16 while in other embodiments, the agitator strip 34 can terminate at a point short of one or both peripheral edge(s) 16.

Figure 15:
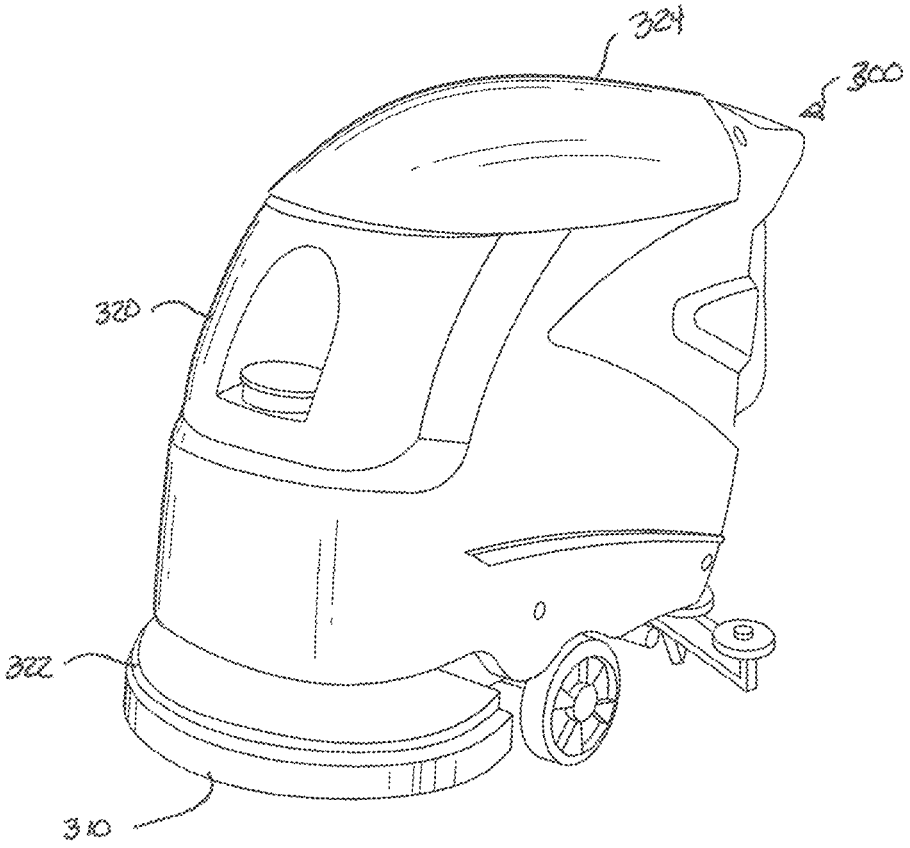
FIG. 15 is a perspective view of one embodiment of an auto scrubber machine configured for use of one or more embodiments of floor cleaning pads as disclosed herein.
Figure 16:
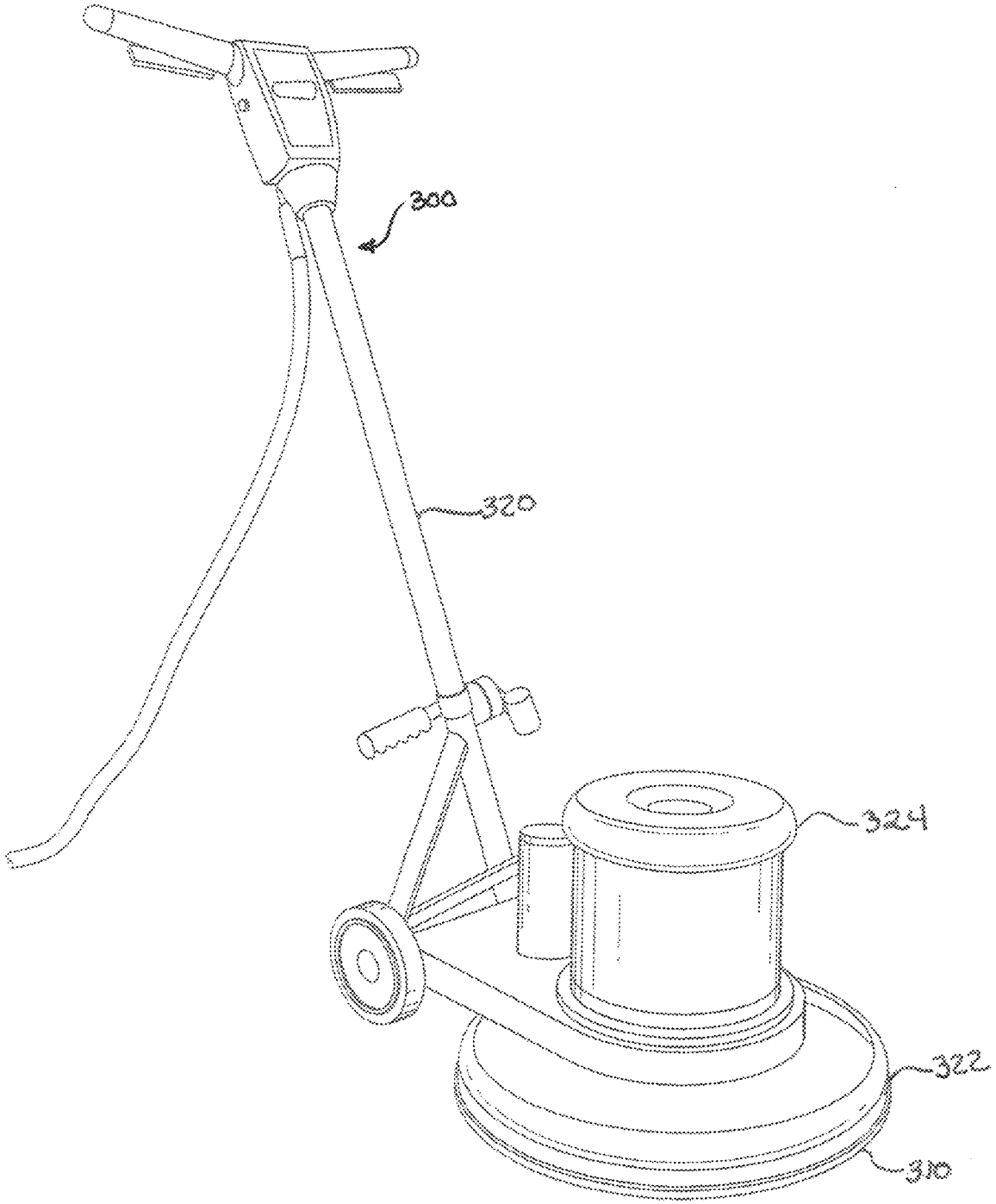
FIG. 16 is a perspective view of one embodiment of a floor buffer machine; configured for use of one or more embodiments of floor cleaning pads as disclosed herein.
Figure 17:
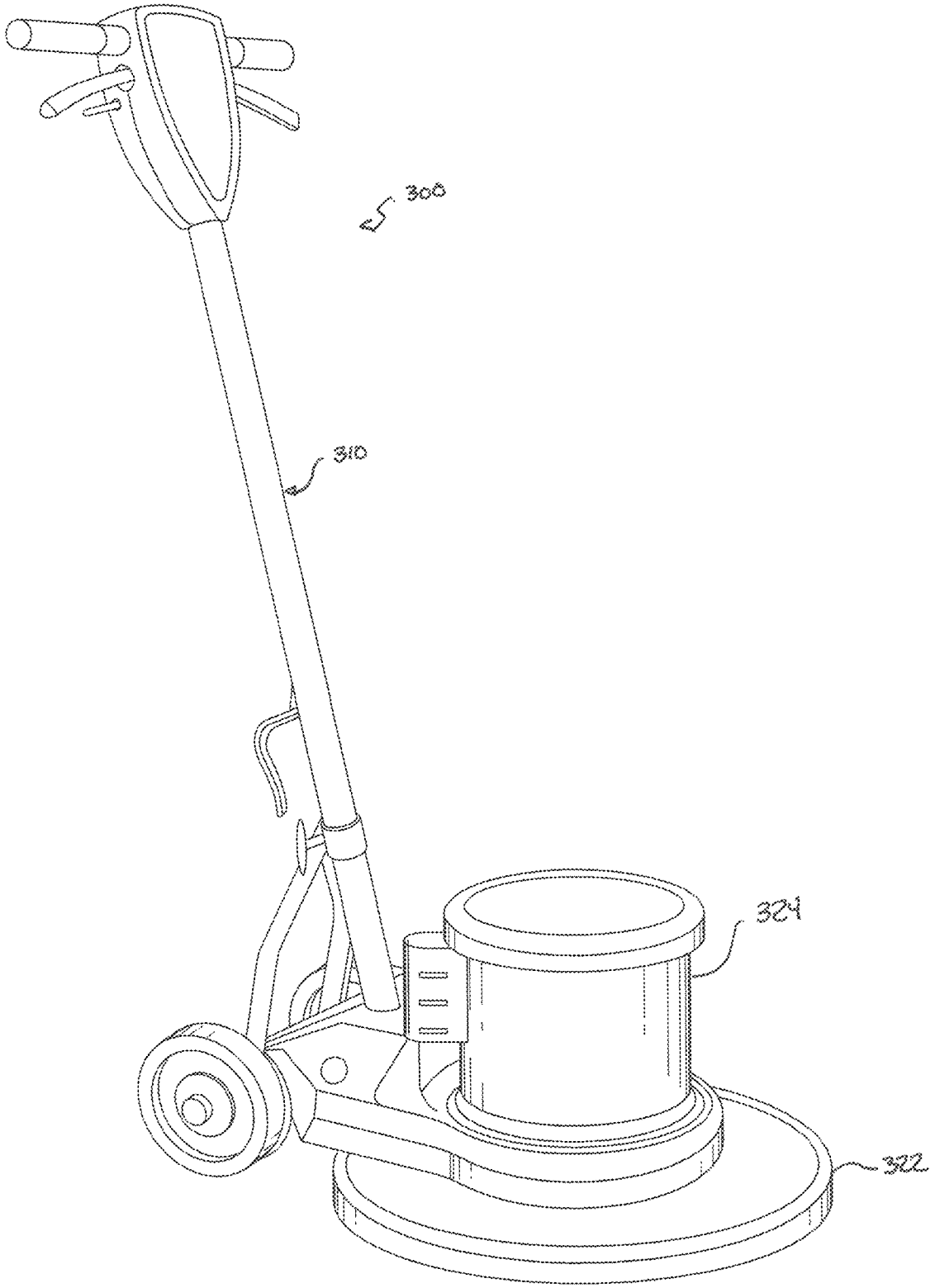
FIG. 17 is a perspective view of one embodiment of a floor burnisher machine configured for use of one or more embodiments of floor cleaning pads as disclosed herein.
Figure 18:
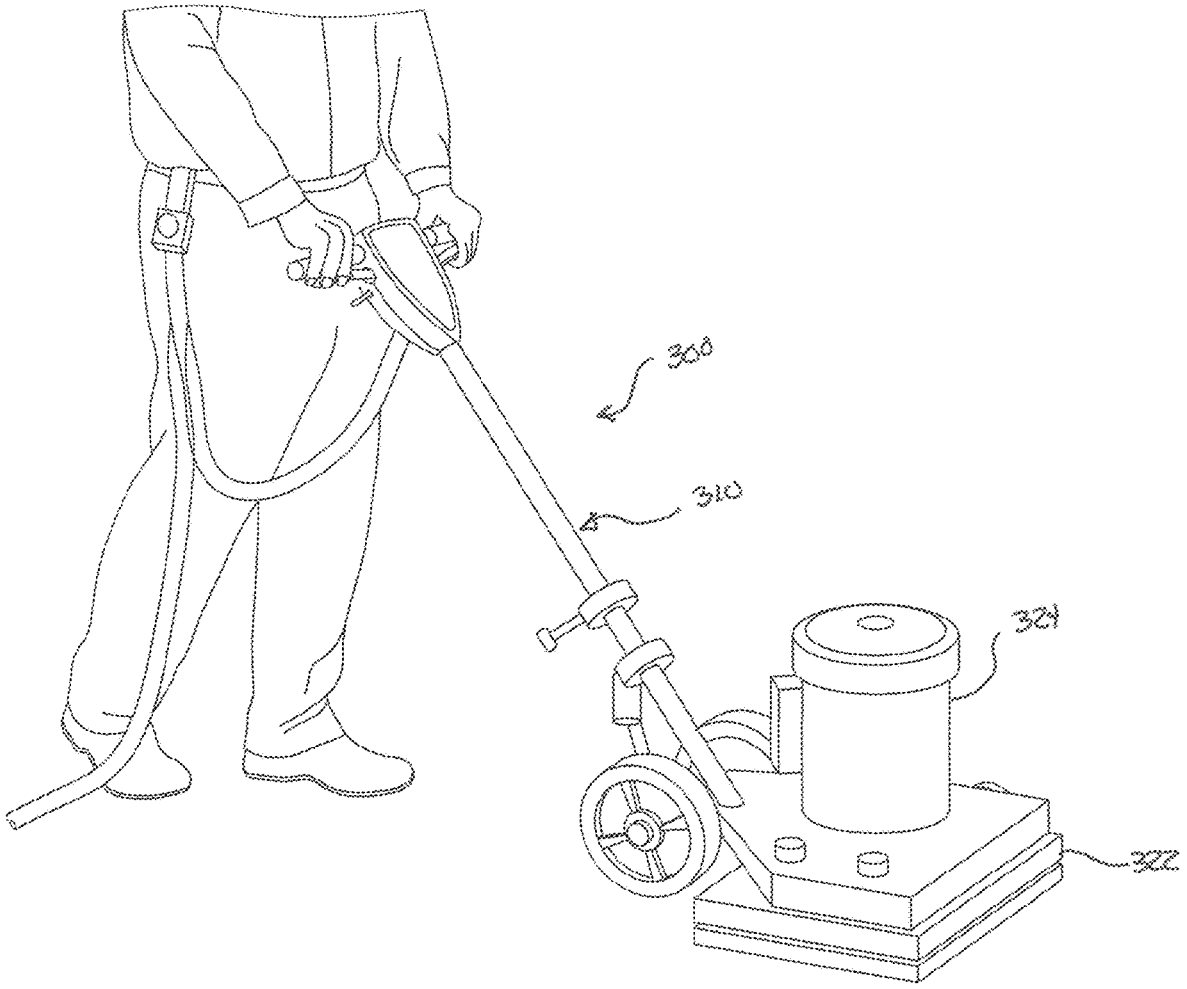
FIG. 18 is a perspective view of one embodiment of a floor random oscillating orbital machine configured for use of one or more embodiments of floor cleaning pads as disclosed herein.
Figure 19:
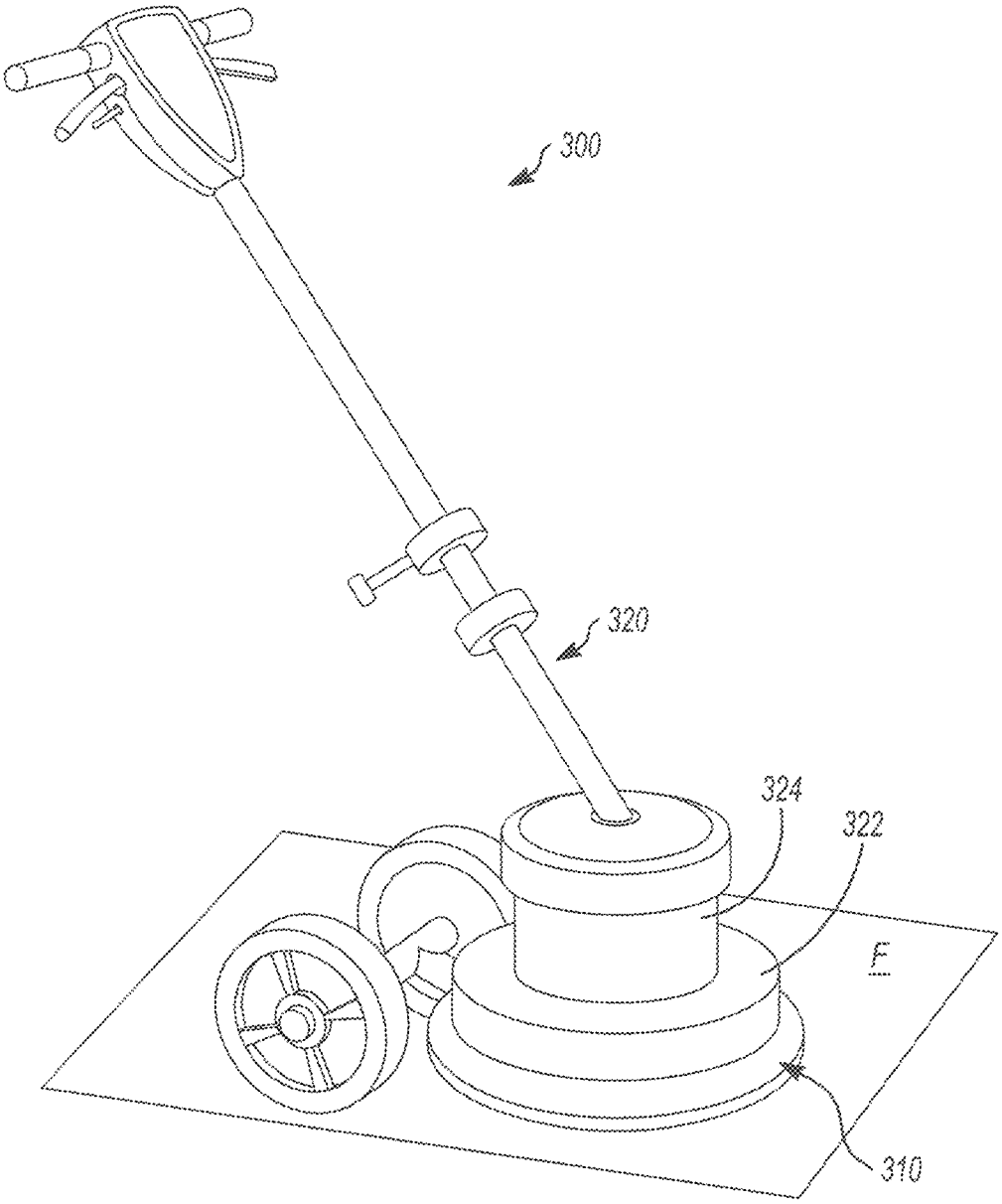
FIG. 19 is an embodiment of the mechanical floor cleaning assembly as disclosed herein.

In the embodiment depicted in FIGS. 1-8, the floor cleaning pad 10 has a support layer 12 that is configured with a circular outer peripheral edge 16. The microfiber loft material layer 18 is connected to the support layer 12 and concentrically disposed within the outer peripheral edge 16 defined by the support layer 12. In the embodiment depicted in FIGS. 9-11, the floor cleaning pad 10' can be configured with a rectilinear outer peripheral edge 16. Other outer peripheral edge geometries are also within the purview of this disclosure. It is contemplated that the circular floor cleaning pads 10 can be employed with various auto scrubbers machine, a non-limiting example of such rotary auto scrubber machine 110 is depicted in FIG. 15 as well as with floor buffers such as the non-limiting example of rotary floor buffer 120 as depicted in FIG. 16 or floor burnishing devices such as the non-limiting example of rotary floor burnisher 130 such as depicted in FIG. 17. It is contemplated that the rectilinear floor cleaning pads 10' can be employed with various random oscillating machines or dual action machines. A non-limiting example of such devices is depicted in FIG. 18 as at reference numeral 140.

Where desired or required, the floor cleaning pad 10, 10' can be configured with one or more through apertures configured to facilitate locating, positioning and/or maintaining the floor cleaning pad 10 in operational position relative to an associated high-speed cleaning polishing or burnishing device. In the embodiments such as that depicted in FIGS. 1, 5, and 7 the floor cleaning pad 10 has a radially positioned central through aperture such as through aperture 36. Where desired or required, the through aperture 36 can include one or more suitable reinforcements such as selvage member 38. The selvage member 38 can be a binding element that serves to fasten the support layer 12 and the microfiber loft material layer 18 together. Non-limiting examples of such fastening methods can include seam binding, serging and the like as desired or required.

In certain embodiments, the floor cleaning pad 10, 10' can also include a suitable outer reinforcement member 40 located at the outer peripheral edge 16 and can extend along all or part of the outer periphery 16. The outer reinforcement member 40 can be configured to impart structural stability to the floor cleaning pad 10, 10' and/or to facilitate the connection between the support layer 12 and the microfiber loft material layer 18. The outer reinforcement member 40 can be configured as a seam binding, a serged member and the like, where desired or required.

Figure 5:
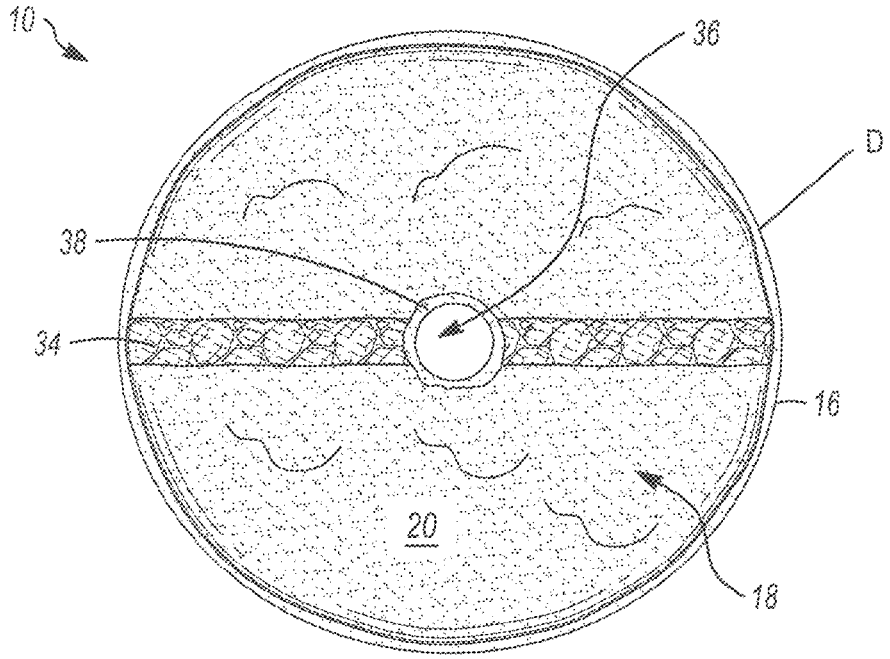
FIG. 5 is a top view of the floor cleaning pad of FIG. 1.
Figure 6:
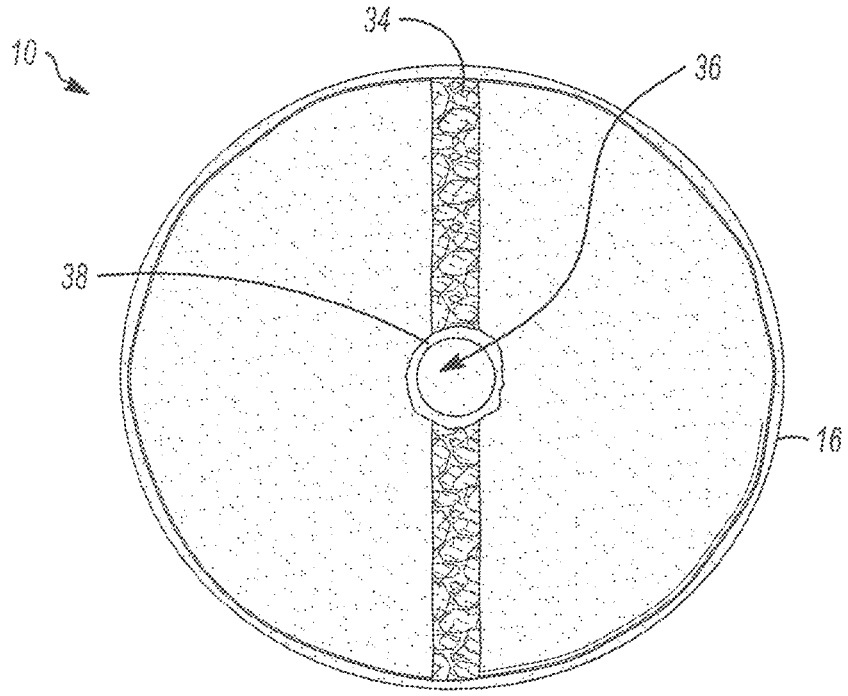
FIG. 6 is a perspective view of the floor cleaning pad of FIG. 1 as viewed from the bottom surface.
Figure 7:
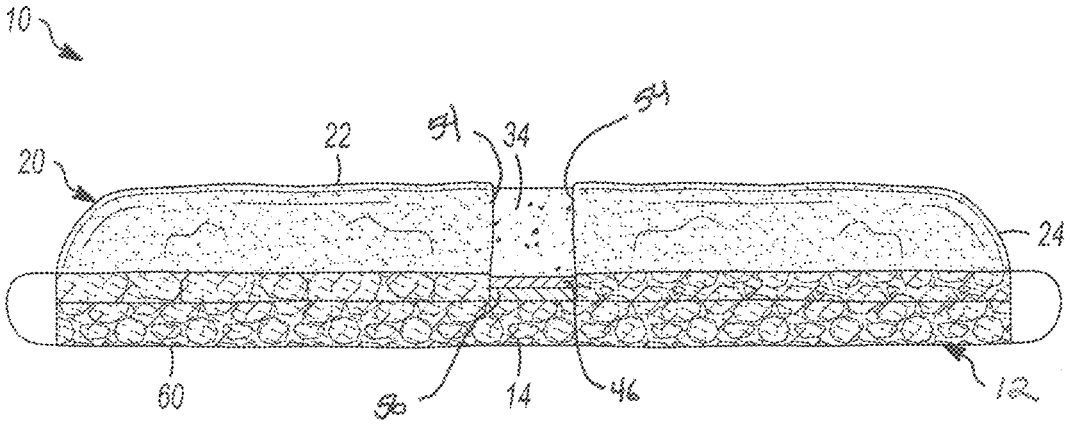
FIG. 7 is a cross-sectional view of a second embodiment of the floor cleaning pad as disclosed herein.
Figure 8:
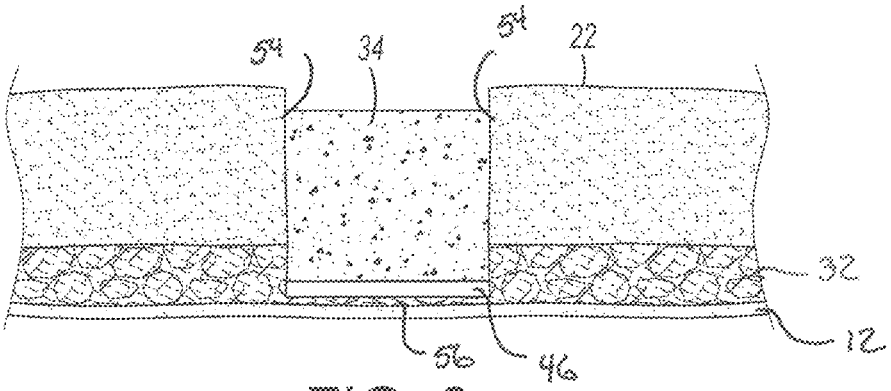
FIG. 8 is an alternate detail cross-sectional view of FIG. 2.

In certain configurations, it is contemplated that the at least one agitator strip 34 can include at least one edge element that is connected to at least one of the central selvage member 38 (where present as illustrated in FIGS. 5 and 6) and/or the outer reinforcement member 40. In the embodiments such as that depicted in FIG. 5, at least two agitator strips 34 extend from the central selvage member 38 to the outer reinforcement member 40 and are located at axially opposed regions of the floor cleaning pad 10. In some embodiments in which the floor pad has a non-circular or rectilinear periphery, such as the non-limiting examples depicted in FIGS. 9-11 at reference numeral 10', it is within the purview of this disclosure that one or more of the agitator strips 34 can extend from selvage member 38 member to opposed selvage member 38. Where desired or required, one or more agitator strips 34 can extend from a defined region of the selvage member 38 and terminate in an interior region intermediate to the opposed selvage member 38. Particular aspects of the floor cleaning pad 10' having a non-circular or rectilinear periphery will be discussed subsequently.

Where desired or required, the floor cleaning pad 10, 10' can include greater than two agitator strips 34. In certain configurations, the floor cleaning pad such as floor cleaning pad 10 can have a circular configuration and can include greater than two agitator strips 34. Where desired or required, the greater than two agitator strips 34 can be axially disposed around the floor cleaning pad 10 as in configurations where the outer periphery has a circular configuration.

One or more of the agitator strips 34 present in the floor cleaning pad as disclosed herein such as floor cleaning pad 10, 10' can be composed of as suitable synthetic pile fabric. The suitable synthetic pile fabric present in agutator strips can include a backing member and pile elements supported on the backing member. The synthetic pile elements present in the one or more agitator strip 34 can be randomly configured as a plurality of straight, bent and/or randomly oriented pile elements 44. Where desired or required, in certain configurations, the synthetic pile elements 44 can have a height $H_P$. The height $H_P$ can be less than or equal to the height $H_L$ of the microfiber loft material layer. In certain embodiments, the pile elements 46 can have a height between 0.5 and 1.5 inches, with a height between 0.5 and 0.75 inches in certain situations.

In certain embodiments the pile fabric can have a general stiffness value that is greater than the stiffness value of the material present in the microfiber loft material layer 18. The term "stiffness value" as the term is defined herein can be defined as the compressibility of the respective materials under applied pressure. In certain embodiments, the stiffness value of the loft material present in the microfiber loft material layer 18 can be between 30% and 90% of the stiffness value of the material of the pile elements 44 in the agitator strip 34.

Where desired or required, the synthetic pile elements such as synthetic pile elements 44 present in the agitator strip 34 can be composed of cut pile fibers, loop or mixtures of the two. In certain embodiments, the synthetic pile elements 46 present in the agitator strip 34 can be composed, at least in part of at least one of the following polyamides, polyesters, polyethylene, vinyl-vinylidene chloride, polyvinyl chloride, polyacrylonitrile, cellulose acetate, cellulose triacetate, rayon, glass and the like. Where desired or required, the synthetic pile fibers such as those present in synthetic pile elements 44 can include extruded monofilaments and may be configured as monofilament ribbons. In certain embodiments, the monofilaments can have size greater than 300 denier; greater than 500 denier; greater than 700 denier; greater than 120 denier; between 300 denier and 1200 denier; between 500 and 1200 denier; between 700 and 1200 denier.

Figure 2:
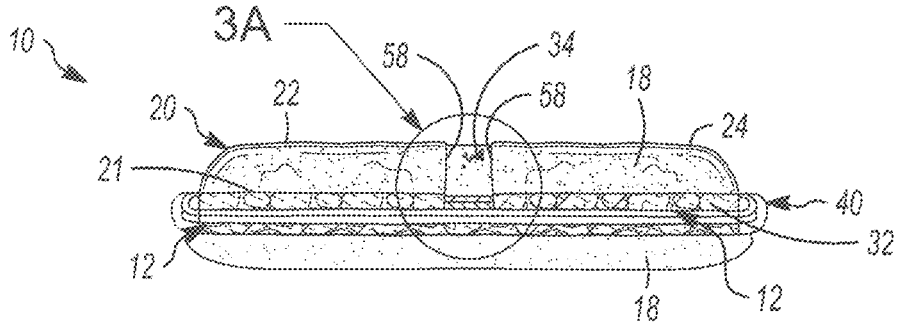
FIG. 2 is a cross-sectional view of the floor cleaning pad as disclosed herein taken along the 2-2 line of FIG. 1.

The backing member of the agitator strip 34 such as backing member 46 can be configured as a scrim material, a knitted material, a non-woven material or the like. In certain embodiments, the pile element such as pile element 44 can be tufted into the backing member 46 as desired or required. In such configurations, the backing member 46 can have a first face 48 and a second face 50 opposed to the first face 48. In the embodiment as depicted in FIGS. 1-3, the pile element 44 projects outward from the first face 48 of the backing member 46 of the agitator strip 34.

The at least one agitator strip such as agitator strip 34 can be connected to the connected to the support layer 12 in a manner that maintains the at least one agitator strip 34 in fixed position relative to the microfiber loft material layer 18 during and after the rotational or oscillational movement of the associated floor cleaning pad 10, 10' as imparted by a suitable mechanical cleaning device during various floor cleaning and maintenance operations.

In certain embodiments, the at least one agitator strip such as agitator strip 34 is maintained in a suitable slot 52 defined in at least one microfiber loft material layer 18 at a suitable location. The slot 52 can have suitably configured side wall members 54. The side wall members 54 of the slot 52 defined in the microfiber loft material layer 18 can be oriented at an angle relative to the at least one support layer such as support layer 12. In certain embodiments, the angle defined by the side wall members 54 of the slot 52 relative to the support layer 12 can be 90°±15° to 30°.

In certain embodiments, the slot 52 can include a floor member 56 that is located proximate to the support layer 12. In certain other embodiments, the floor member 56 defined by a portion of the first or upper face of the support layer 12 with the side wall members 54 projecting upward therefrom.

In certain embodiments, the floor member 56 of the slot 52 can be composed of between 10 and 100% microfiber. In certain embodiments, the microfiber loft material present in the floor member can be composed of between 30 and 100% microfiber; between 40 and 100% microfiber; between 50 and 100% microfiber; between 60 and 100% microfiber; between 70 and 100% microfiber; between 80 and 100% microfiber.

The microfiber that is employed in the floor member 56 can have microfibers having a size less than 0.7 denier. In certain embodiments it is contemplated that the microfibers will have an average size less than 0.7 denier. In certain embodiments, between 50 and 100% of the microfiber loft layer material layer 18 can be composed of microfibers having a size less than 0.7 denier; less than 0.6 denier; between 0.5 denier.

The microfiber content present in the floor member 56 of slot 52 can contain polymeric fibers. The polymeric material employed in the microfiber can be one or more of polyesters, polyamides, polyolefins, conjugates of polyesters and polyamides, conjugates of polyesters and polyolefins, conjugates of polyamides and polyolefins, conjugates of polyesters, polyamides and polyolefins, and the like. Non-limiting examples of suitable polyolefins include polyethylene, polypropylene and the like. In certain embodiments, the microfibers can be polyester.

In certain embodiments, polymeric material present in the floor member 56 of slot 52 can be the same as or similar to the material employed in the microfiber loft material layer 18 but in a compressed state. When the floor member 56 is composed of polymeric material of the same or similar material composition of that employed in the microfiber loft material layer 18, it is contemplated that the material in the floor member 56 will have a density $D_F$ that is greater than that the density $D_L$ of the microfiber loft material layer 18. In certain embodiments, it is contemplated that density $D_F$ of the polymeric material of the floor member 56 can be at least 10% greater than the density $D_L$ of the polymeric material present in the microfiber loft material layer 18. In certain embodiments, the density will be at least 20% greater; at least 30% greater; at least 40% greater; at least 50% greater; at least 60% greater; at least 70% greater; at least 80% greater; at least 90% greater. In certain embodiments, the dense polymeric loft material that can be present in the floor member 56 include multiple melt-bonded interconnections between various microfiber filaments.

Where desired or required, the microfibers that make up the floor member 56 can contiguously extend from floor member 56 and be connected to the regions of the microfiber loft material layer 18 that are generally proximate to the floor region. In certain embodiments, at least a portion of the microfiber filaments present in the floor member 56 extend into the associated region of the microfiber loft material layer 18 proximate thereto.

The slot(s) such as slot(s) 52 defined in the microfiber loft material layer such as microfiber loft material layer 18 can be formed various methods including but not limited to laser cutting or heat embossing. Where desired or required, a suitably configured agitator strip can be positioned in the desired slot 52 prepared in the floor cleaning pad 10, 10' such that the second face 50 of backing member 46 of agitator strip 34 can be connected to the cleaning pad 10, 10' either directly to the support layer 12 such as to the first surface 28 of the backing layer 26 or can be connected to the floor member 56 by any suitable mechanism such as adhesive bonding, mechanical attachment and the like. Non-limiting examples of adhesive attachment mechanisms include gluing, heat welding and the like. Non-limiting examples of mechanical attachment mechanisms include stitching, clamping mechanisms and the like. It is also contemplated that the agitator strip such as agitator strip 34 can be fastened by a combination of attachment mechanisms. In certain embodiments, agitator strip 34 can be fastened in place in the desired slot 52 using a combination of methods such as employing a suitable adhesive method associated with at least a portion of the backing layer 26 and contact with by the outer reinforcement member 40 and/or selvage member 38.

Where desired or required, attachment mechanism between the agitator strip 34 and the floor cleaning pad 10, 10' can include an interference fit component in addition to the mechanical or adhesive attachment such as that described previously. In certain embodiments, the slot 52 defined in the microfiber loft layer 18 includes side walls 58 that are composed of microfiber loft material that can be randomly or partly randomly oriented and has a density as previously noted. In certain embodiments, it is contemplated that a portion of the microfibers proximate to the side walls 58 can interconnect into spaces defined in the synthetic pile fibers in the agitator strip 34.

As indicated previously, the floor cleaning pad 10, 10' as disclosed can be configured to be positioned on a suitable high-speed machine floor cleaning machine. Non-limiting examples of such high-speed floor cleaning machines are depicted in FIGS. 15-18. In certain embodiments, the floor cleaning pad 10, 10' can be configured to facilitate operative placement and connection between the respective floor cleaning pad 10,10' and the associated floor cleaning machine. In certain embodiments the support layer 12 can be configured to include a cleaning machine contacting face such as cleaning machine contacting face 60. In the embodiment depicted in FIG. 7 cleaning machine contacting face 60 is located in the support layer 12 on a face that is opposed to the microfiber layer 18. The cleaning machine contacting face 60 can include suitable topography to facilitate frictional contact between the floor pad 10, 10' and the associated cleaning machine. Non-limiting examples of such can include indentations, surface roughening and the like. Where desired or required, the machine contacting face 60 can include one or more individual attachment mechanisms that are configured to releasably contact mating elements located on the associated cleaning machine. Where desired or required, the machine contacting face 60 can be configured with attachment devices such as snaps, hook and loop fastening devices and the like.

In certain embodiments, attachment and orientation between the floor cleaning pad 10 can be facilitated by projection of one or machine members into a suitably configured aperture defined in the floor cleaning pad 10 such as through aperture 36. In certain embodiments, the suitably configured aperture such as can include suitable reinforcement mechanisms that can engage projection(s) present in the associated cleaning machine such as a rotation spindle.

The present disclosure also contemplates that, in certain embodiments, the floor cleaning pad 10, 10' can be reversable and can include cleaning layers that are opposed to one another with at least one support layer interposed therebetween. The floor cleaning pad 10, 10' has two microfiber loft material layers 18, 18 and at least one support layer 12 interposed therebetween. Where desired or required, the floor cleaning pad 10, 10' can include two support layers 12, 12 that are oriented back-to-back with one another with the respective microfiber loft material layers 18,18' projecting outward therefrom. The two support layers 12, 12 can be joined to one another to one another in any suitable manner to form a stable member. In the embodiments such as that depicted in FIGS. 1-3, the two respective support layers 12, 12 and the associated microfiber loft material layers 18, 18 can be connected to one another at a location proximate to the outer peripheral edge 16 by one or more of seam bonding, adhesive bond, welding and the like. The floor pad 10, 10' can include a suitable reinforcement member 40 can be configured to engage the two support layers 12, 12 at or near their respective outer peripheries 16, 16. The outer reinforcement member 40 can be configured as a seam binding, a serged member and the like where desired or required.

In the two-layer embodiment as depicted, at least one of the microfiber loft material layers 18, 18 can include at least one agitator strip 34 as described herein positioned in at least one of the microfiber loft material layers 18, 18. In certain embodiments, the floor cleaning pad 10 can have at least two agitator strips 34 positioned in each of the microfiber loft material layers 18, 18. Where the floor cleaning pad 10 includes at least two agitator strips 34 in the two opposed microfiber loft material layers 18, 18, the respective agitator strips 34 can be indexed relative to each other. Where two axially opposed agitator strips 34 are positioned in the first or upper microfiber loft material layer 18, for examples at the 12 and 6 positions, the two axially opposed agitator strips 34 in the second or lower microfiber loft material layer 18 can be indexed relative to those positions and can be positioned at the 3 and 9 positions for example.

The number and/or size and/or configuration of the agitator strips 34 positioned in a microfiber loft material layer 18 of the floor cleaning pad 10,10' can be governed by factors including, but not limited to, floor surface conditions, dirt and/or contamination levels on the floor surface to be cleaned, the desired floor treatment operations and the like. In certain embodiments, the agitator strip(s) 34 will compose between 1% and 50% of the total working surface area of the floor cleaning pad 10, 10'. In other embodiments, the agitator strip(s) 34 will compose between 2% and 50%; between 3% and 50%; between 4% and 50%; between 5% and 50%; between 10% and 50%; between 15% and 50%; between 20 and 50%; between 30% and 50%; between 40% and 50%; between 45% and 50%; between 1% and 10%; between 2% and 10%; between 3% and 10%; between 4% and 10%; between 5% and 10%; between 6% and 10%; between 7% and 10%; between 8% and 10%; between 9% and 10%; between 5% and 15%; between 5% and 20%; between 5% and 25%; between 10% and 15%; 10% and 20%; between 10% and 30%; between 15% and 30%; between 20% and 30%.

It is also contemplated that one or both of the two microfiber loft material layers 18,18 can include more than two agitator strips 34 where desired or required. In certain embodiments, at least one of the two microfiber loft material layers 18,18 can have three, four five or more agitator strips 34 Where desired or required, the plurality of agitator strips 34 can be radially disposed around the circular face of the associated microfiber loft material layer 18 in spaced relationship. Where desired or required, the plurality of agitator strips 34 can be in equidistant space relationship from one another. Where desired or required, in floor cleaning pads 10 having circular configurations, the two microfiber loft material layers 18,18 can each have three, four five or more agitator strips 34 radially disposed around the circular face of the respective microfiber loft material layer 18 in spaced relationship to one another. The two microfiber loft material layers 18, 18 can be indexed relative to one another such that the respective agitator strips 34 present on the respective microfiber material layers do not overlay one another.

Figure 9:
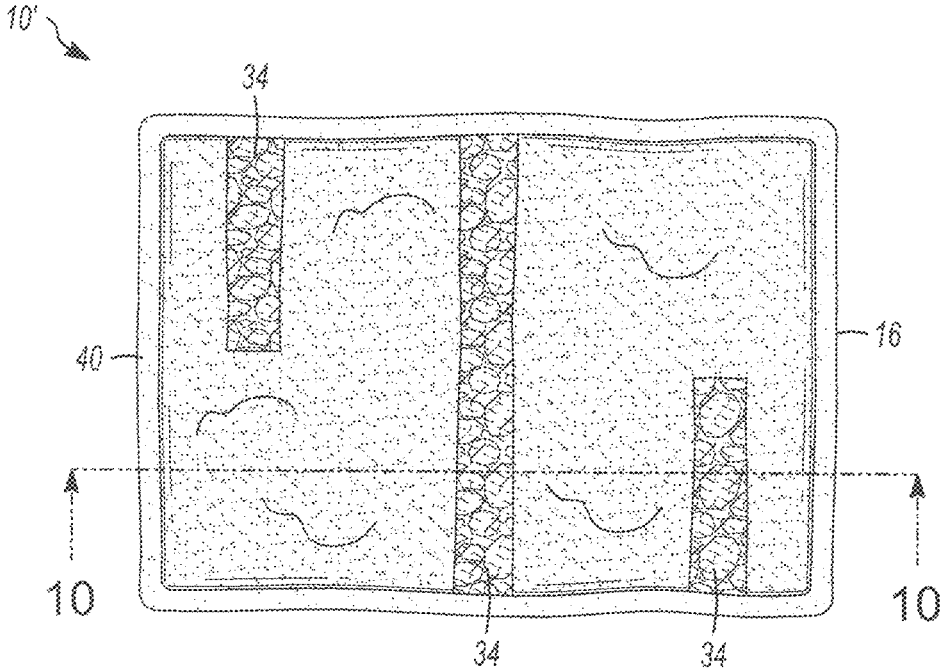
FIG. 9 is a third embodiment of the floor cleaning pad as disclosed herein.
Figure 10:
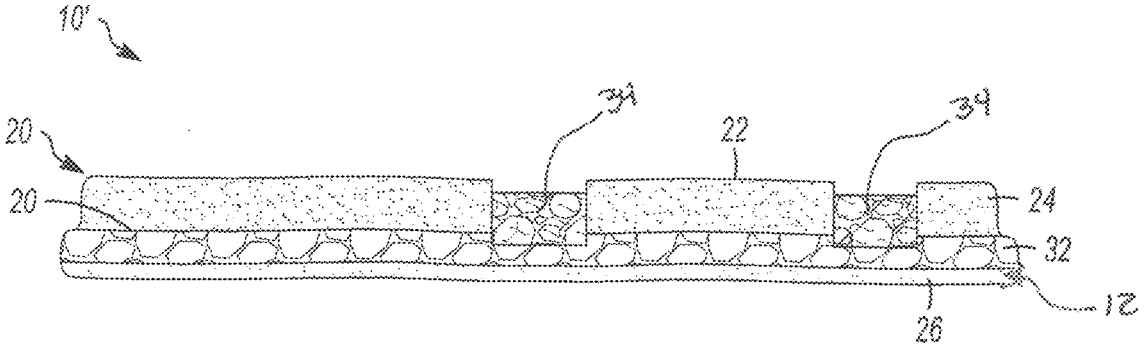
FIG. 10 is a cross-sectional view of FIG. 9 taken along the 10-10 line.
Figure 11:
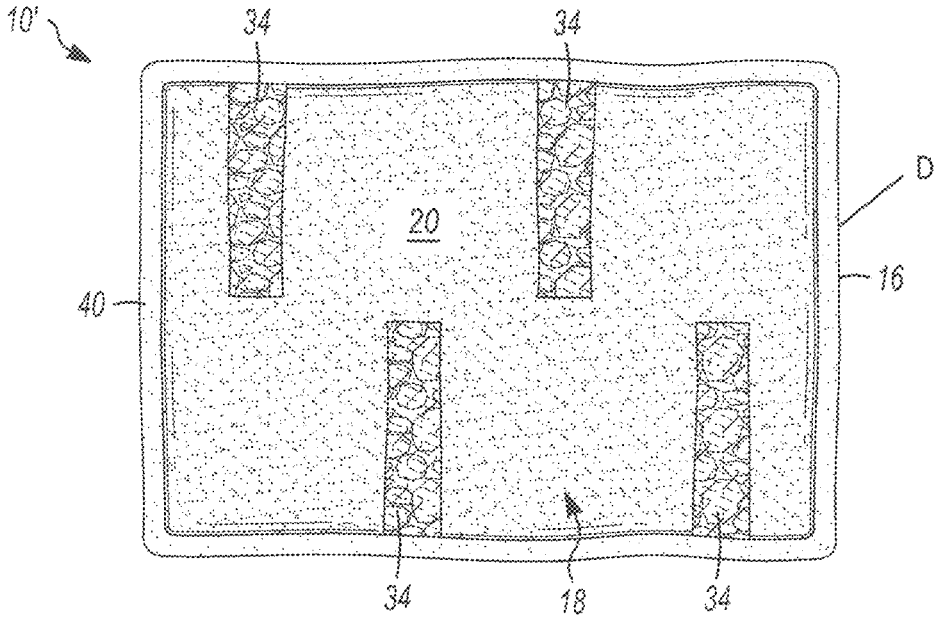
FIG. 11 is a fourth embodiment of the floor cleaning pad as disclosed herein.
Figure 12:
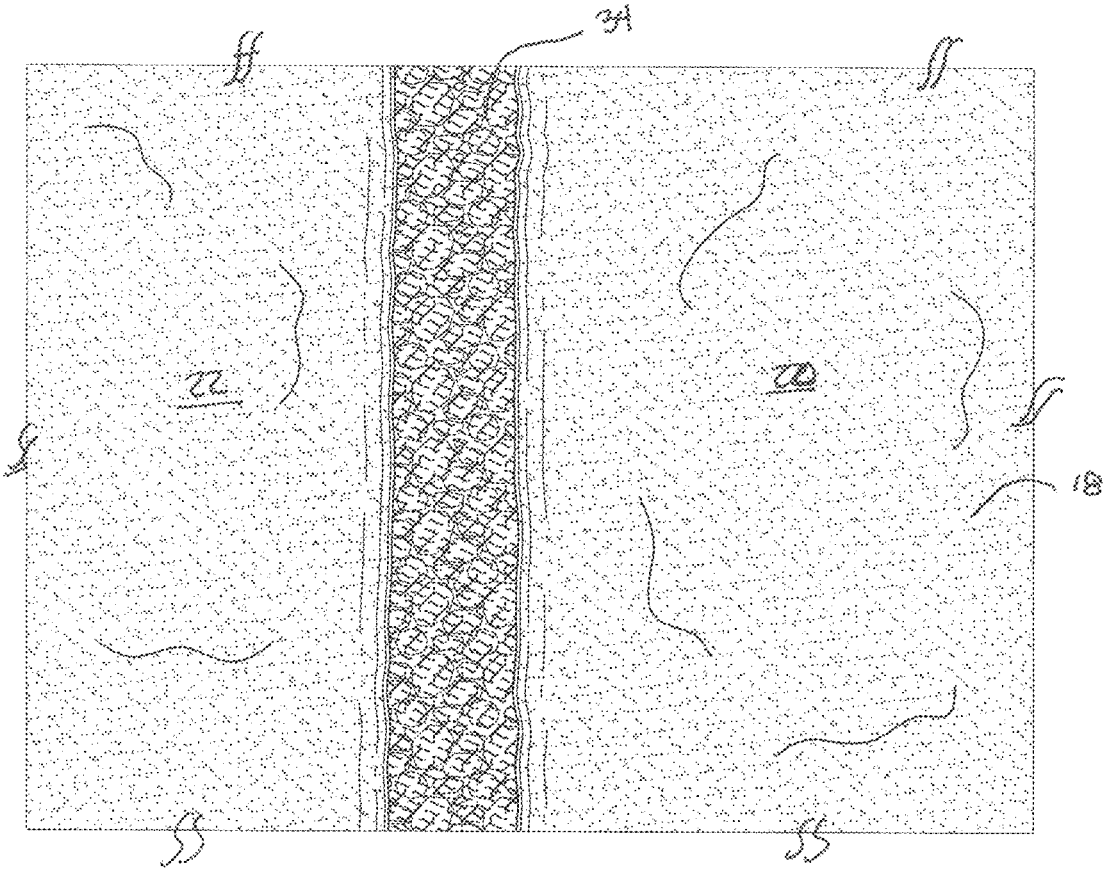
FIG. 12 is a detail top view of an embodiment of the floor cleaning pad as disclosed herein.
Figure 13:
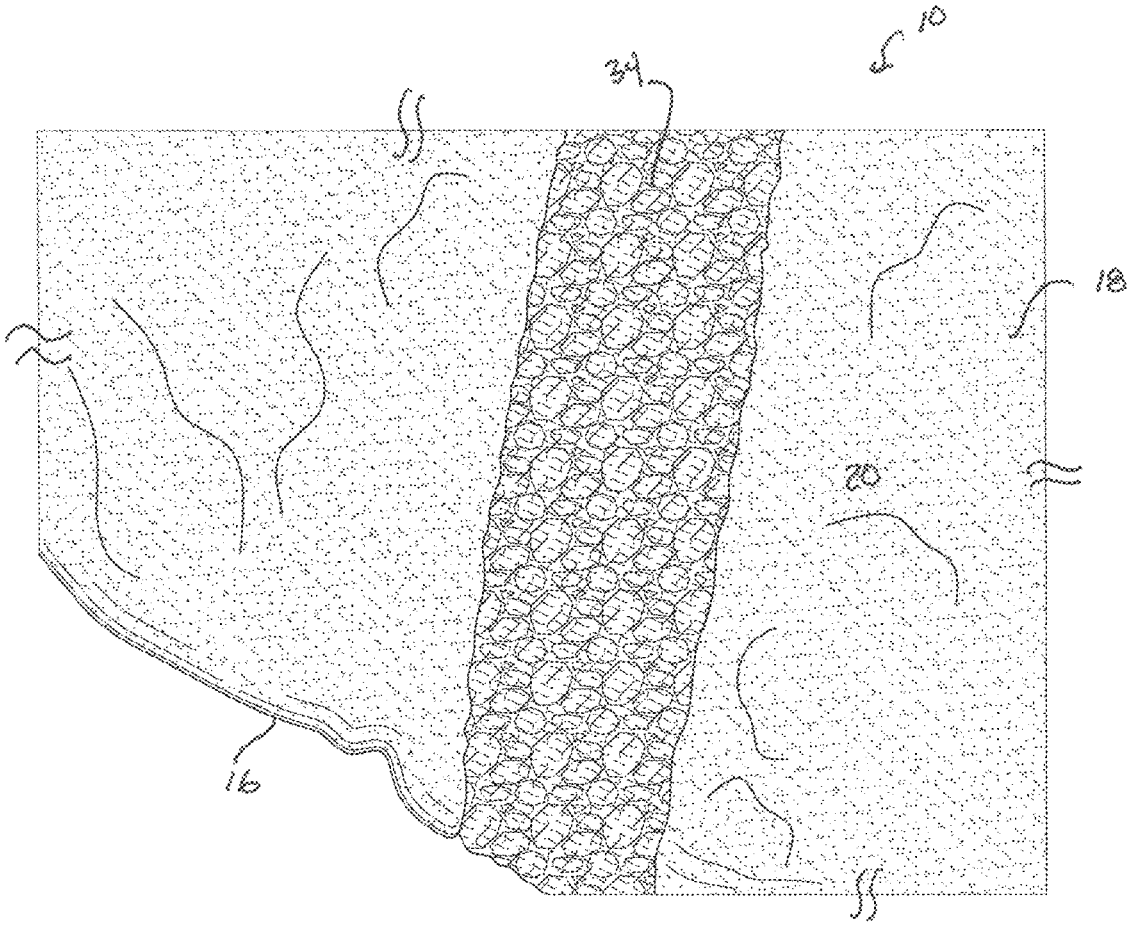
FIG. 13 is the detail top view of the floor cleaning pad of FIG. 12.
Figure 14:
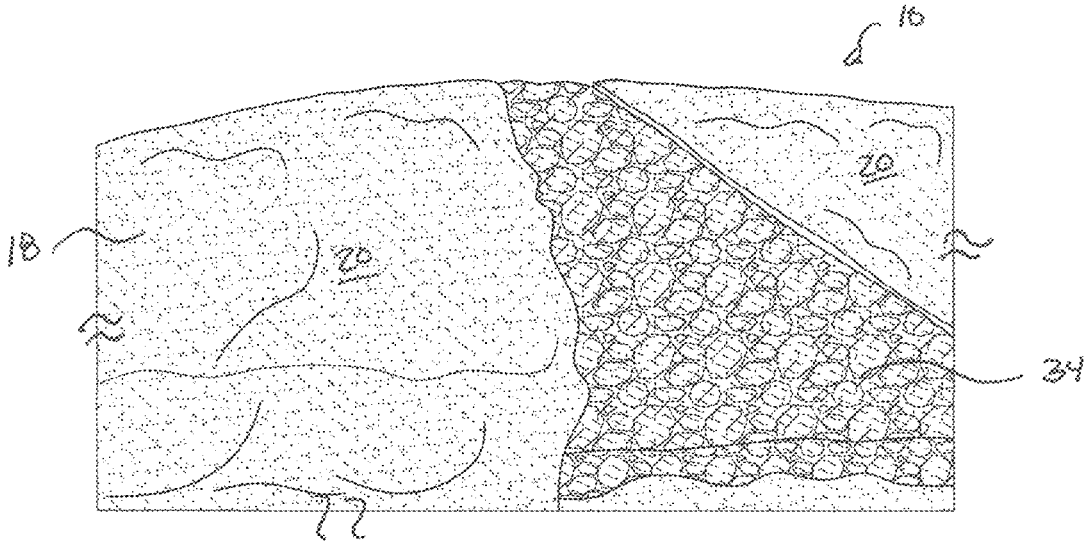
FIG. 14 is a detail side view of the floor cleaning pad of FIG. 12 with outer seam removed.

In certain embodiments, the outer periphery 16 can be rectilinear. Non-limiting examples of configurations of the floor cleaning pad 10' are depicted in FIGS. 9, 10 and 11. It is contemplated that the floor cleaning pad 10' can be configured with one or more agitator strips 34 that extend from selvage to selvage if desired or required. One example of a non-limiting embodiment configured as such is depicted in FIGS. 9 and 10. Where desired or required, the floor cleaning pad 10' can include one or more agitator strip(s) 34 that extend into the central body of the floor cleaning pad 10' and terminate there. Non-limiting examples of such embodiments are illustrated at FIGS. 9 and 11. Where shorter agitator strips 34 are employed, the truncated agitator strips may be positioned in spaced relationship on the face of the floor cleaning pad 10'. In certain embodiments, truncated agitator strips can be oriented to extend into the central portion of the face of the floor cleaning pad 10' from opposed sides of the periphery of the floor cleaning pad 10'. In certain embodiments, the truncated agitator strips 34 can be positioned in an alternating manner across either the longitudinal face or the latitudinal face of the floor cleaning pad 10'. The termination point of the truncated agitator strip(s) 34 can be at or near a longitudinal or latitudinal axis, such as longitudinal axis A in FIG. 11. In certain embodiments, one or more of the truncated agitator strip(s) 34 can terminate at the longitudinal axis A.

The agitators strip(s) employed in the floor cleaning pad 10' can have any suitable configuration. Non-limiting examples of configurations for one or more agitator strip(s) 34 has been discussed previously. One or more of the agitator strip(s) 34 can be attached to the floor cleaning pad 10' in a manner that anchors the agitator strip(s) to the floor cleaning pad 10' in an manner that permits use with a suitable floor cleaning machine and maintains the structural integrity of the floor cleaning pad 10'. Non-limiting examples of suitable anchoring mechanisms have been discussed previously.

It is believed that floor cleaning pads 10' configured with one or more lateral agitator strip(s) 34 can be employed effectively with various floor cleaning machines. It is contemplated that floor cleaning pads such as floor cleaning pads 10' embodiments of which are depicted in FIGS. 9-11 can be advantageously employed with devices such as random oscillating orbital floor cleaning machines, dual action floor cleaning machines and the like.

Without being bound to any theory, it is believed that the integration of a floor cleaning pad 10, 10' with floor cleaning machine configured with one of rotary movement mechanisms, random oscillating orbital mechanisms and/or dual action, rotary and random oscillating orbital mechanisms can accomplish enhanced floor cleaning results. As broadly disclosed, the present disclosure is also directed to a floor cleaning assembly that comprises a floor cleaning machine having at least one apparatus configured to impart oscillating, rotational or rotational/oscillating action to a floor cleaning pad removably attachable thereto. Non-limiting examples of floor cleaning apparatus devices as disclosed herein are depicted in FIGS. 15-19 each as at reference numeral 300. The floor cleaning assembly 300 as broadly disclosed comprises a floor cleaning machine 320 and a floor cleaning pad 310. The floor cleaning machine 320 can include a housing 324 that can include at least one motor (not shown) operatively mounted therein. The housing 324 can have any suitable configuration as desired or required. The at least one motor and be powered by any suitable means. In certain embodiments the power source can be an on board or exterior electrical power source. Non-limiting examples of on-board power source include on-board batteries, power cells and the like. The floor cleaning machine 320 can have suitable power cords and the like to access and use eternal power sources.

The floor cleaning machine 320 will a include suitable actuation device such actuator (not shown) that is operatively connected to the motor. The at least one actuator can be configured to translate power output into rotational, oscillating or rotational-oscillating movement and to impart at least one of rotational movement, oscillating movement, rotational and oscillating movement to at least one output device. In certain embodiments, the output device can be directly or indirectly coupled to the motor. The output device can include at least one attachment mechanism that is configured to connect to at least one floor cleaning pad such as floor cleaning pad 310. Non-limiting examples of attachment mechanisms include central spindles (not shown), planar plates such as planar plate member 322 and the like.

In certain embodiments, the planar plate member 322 can serve to orient and maintain the floor cleaning pad 310 in an operative position relative to the floor to be cleaned. It is contemplated that the planar plate member 322 can have a surface configured to permit engagement with a floor cleaning pad 310 and the floor cleaning pad such as floor cleaning pad 310 in operative engagement with the floor during floor cleaning operations. Where desired or required, the planar member can impart sufficient downwardly oriented pressure to the associated floor cleaning pad to facilitate floor cleaning operations. Non-limiting examples of floor cleaning operations include wet floor cleaning or mopping, dry floor cleaning, burnishing and the like.

Where desired or required, the planar plate member 322 can be configured to impart movement (such as rotational, oscillating or both) to the floor cleaning pad such as floor cleaning pad member 322. In certain embodiments, the floor cleaning pad such as floor cleaning pad 210 can be releasably connected to planar plate member 322. The floor facing face of the planar plate member 322 can be configured to the releasably engage the floor cleaning pad 210 and to permit replacement of the floor cleaning pad as desired or required. The planar plate member 322 can be configured with additional attachment mechanisms if desired. Non-limiting examples of such attachment mechanisms include hook and loop fastener(s) and the like.

The lower or floorward oriented face of the planar plate member 322 can have a geometric configuration and/or dimensions suitable to accommodate an associated floor cleaning pad. In certain embodiments, the planar plate member 322 can have a geometric configuration such as circular, rectilinear, or the like.

The floor cleaning pad 10, 10' can be one having at least one cleaning surface layer that is connected to a support layer. In certain embodiments, the at least one surface cleaning layer can be a loft material layer that is positioned in overlaying relationship to the support layer. The loft material layer can be connected directly to the support layer or can be connected to one or more intermediate layers which include one directly connected to the support layer. The loft material layer can include at least one polymeric fiber loft material. The loft material layer can have a height $H_L$. In various embodiments, the loft material constitutes at least a portion of the outwardly facing surface 20.

The support layer such as support layer 312 includes a central region and an outer peripheral edge that defines the outer periphery of the floor cleaning pad 310. The outer periphery of the support layer 212 can have a suitable geometric shape such as a circular periphery, a rectilinear periphery or the like. In various embodiments, the planar plate member 222 can have geometrical configurations and dimensions similar to those of the support layer 212. In certain embodiments, the loft material layer such as loft material layer 218 can be dimensioned similarly to the support layer 212.

Figure 20A:
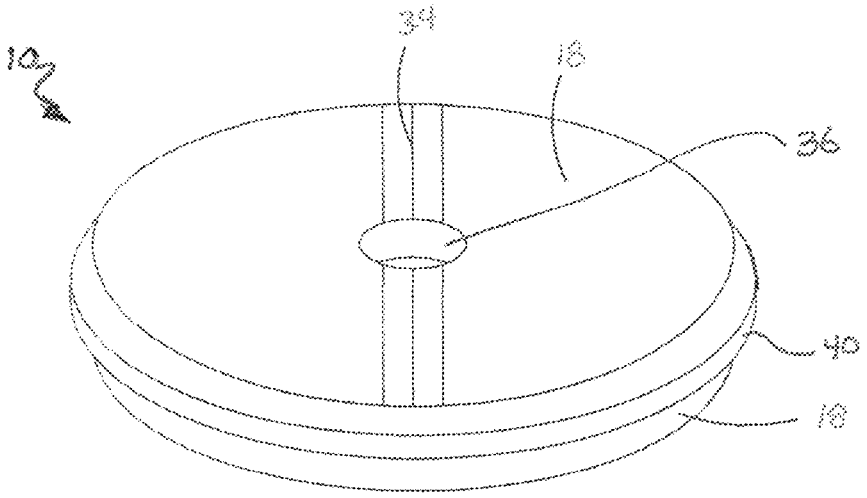
FIG. 20A is a perspective view of a first embodiment of a floor cleaning pad that can be employed with the mechanical floor cleaning assembly as disclosed herein.
Figure 20B:
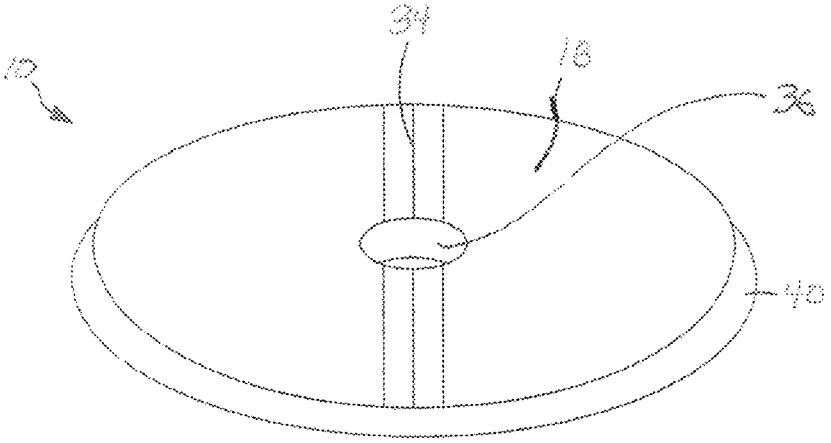
FIG. 20B is a perspective view of a second embodiment of a floor cleaning pad that can be employed with the mechanical floor cleaning assembly as disclosed herein.

The floor cleaning pad such as floor cleaning pad 210 can be configured with a support layer 218 and a suitable support layer 212. In the embodiment as depicted in FIG. 20A, the support layer 212 can have a first face to which the loft material layer 218 is connected and a second face opposed to the first face. The second face of the support layer 212 can be configured to releasably engage the planar plate member 222 to permit operative rotational, oscillating or rotational oscillation of the loft material layer 218 of the floor cleaning pad with the floor surface F. Non-limiting examples of such connection enhancements can include suitably configured hook and loop fastener mechanisms and the like. In the embodiment as depicted in FIG. 20B, the floor cleaning pad 210 can be configured with two opposed loft material layers 218, 218. The two opposed loft material layers 218 can be connected to one or more support layer(s) 212. The loft material present in the loft material layer 218, 218 can be composed of at least one polymeric fiber loft material that defines the outwardly oriented face(s) of the floor cleaning pad 210. In certain embodiments, the loft material layer can have a height $H_L$. The height of the loft material layer can have a value and/or material composition such as those defined previously.

The floor cleaning pad 210 as used in the floor cleaning assembly 200 also has at least one agitator strip 234 overlaying a portion of the support material layer 212 and connected thereto. In certain embodiments, the at least one agitator strip is positioned such that the loft material layer bounds the agitator strip 234 on at least one side. The at least one agitator strip 243 has a height $H_A$ and an outwardly facing surface 21. When the at least one agitator strip is in an operative position in the floor cleaning pad 210, the height $H_A$ of the at least one agitator strip 234 can be equal to or less than the height $H_L$ of the loft material layer 218. In certain embodiments, the at least one agitator strip forms an associated detent to the upper surface of the floor cleaning pad such as floor cleaning pad 210. The outwardly facing surface of the agitator strip is at an orientation planar with or indented relative to the outer face of the loft material layer.

As discussed previously, if desired or required, the loft material in the loft material layer of the floor cleaning pad contains between 50% and 100% polyester fibers and wherein the 50 and 100% of the loft layer material layer is composed of microfibers having a size less than 0.7 denier. The support layer can be comprised of at least one of a synthetic pile fabric, having pile elements having a height $H_P$ less than or equal to the height $H_L$ of the microfiber loft material. In certain embodiments, the pile fibers of the synthetic pile fabric of the agitator strip of the floor cleaning pad is composed of monofilaments extruded from a material that includes at least one of the following polyamides, polyesters, polyethylene, vinyl-vinylidene chloride, polyvinyl chloride, polyacrylonitrile, cellulose acetate, cellulose triacetate, rayon, glass and the like. In certain embodiments, the synthetic pile fibers in the agitator strip of the floor cleaning pad include extruded monofilaments of between 300 and 120 deniers, wherein the monofilaments are configured as monofilament ribbons.

The at least one agitator strip 234 can include a backing member that is one of a scrim material, a knitted material, a non-woven material or the like, wherein the monofilament ribbons are tufted into the backing member. In certain embodiments, the support layer of the floor cleaning pad is a polymeric substrate is at least one of polymeric foam, a woven fiber backing member, a non-woven backing fiber and wherein the backing member of the agitator strip is positioned in a detent defined in the support layer. In certain embodiments, the backing member is connected to the support layer by suitable means including stitching, adhesive bonding and the like. The floor cleaning pad employed in the floor cleaning assembly can include a floor region, the floor region interposed between the backing member of the agitator strip and the support member. The floor region can be configured as previously discussed. In certain embodiments, the floor region can be composed of loft material that is the same as or compatible with the loft material employed in the surrounding loft material layer. The loft material layer of the floor cleaning pad can have a density $D_L$. The floor region can have a density $D_F$, with the density $D_F$ of the floor region being at least 10% greater than the density $D_F$ of the loft material region. In certain embodiments the density differential can be imparted by press welding if desired or required.

Figure 3A:
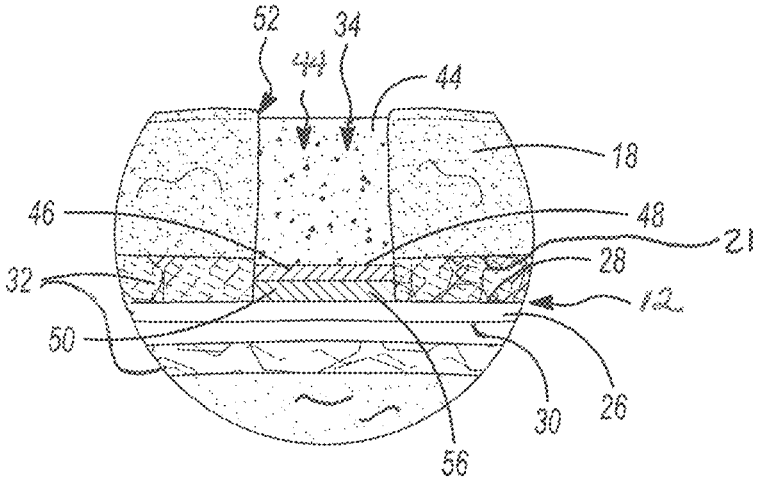
FIG. 3A is a detail cross-sectional view of FIG. 2.
Figure 3B:
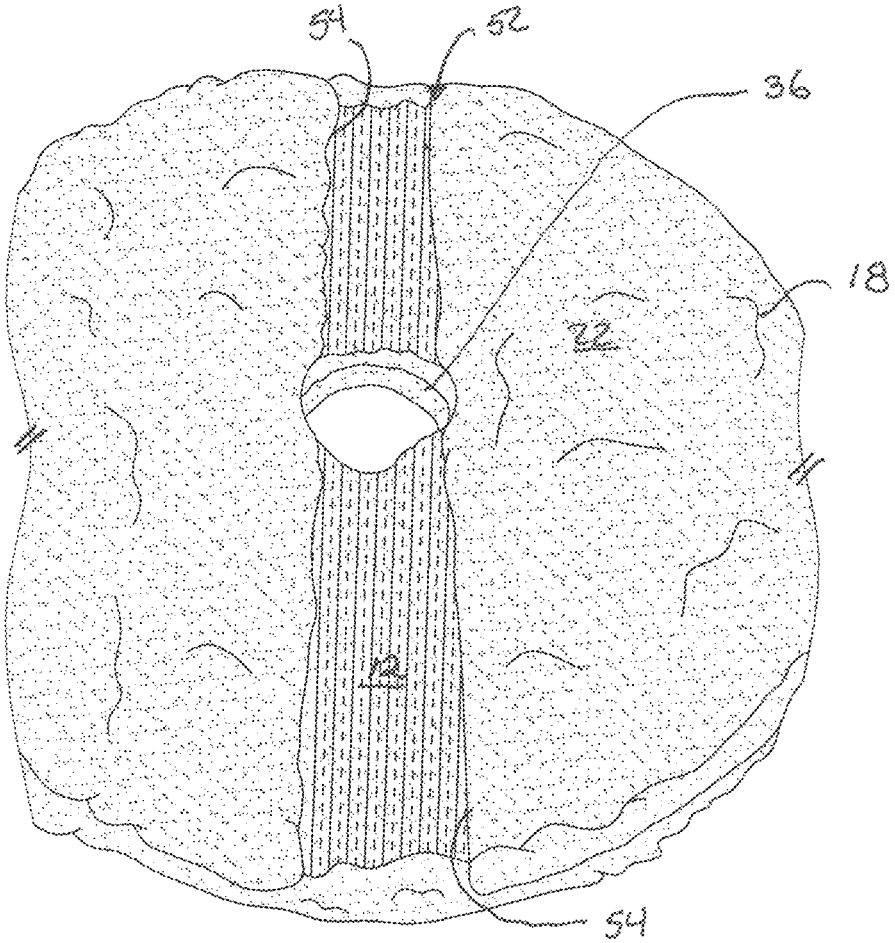
FIG. 3B is a perspective view of an embodiment of the floor surface region of the floor cleaning pad of FIG. 1.
Figure 3C:
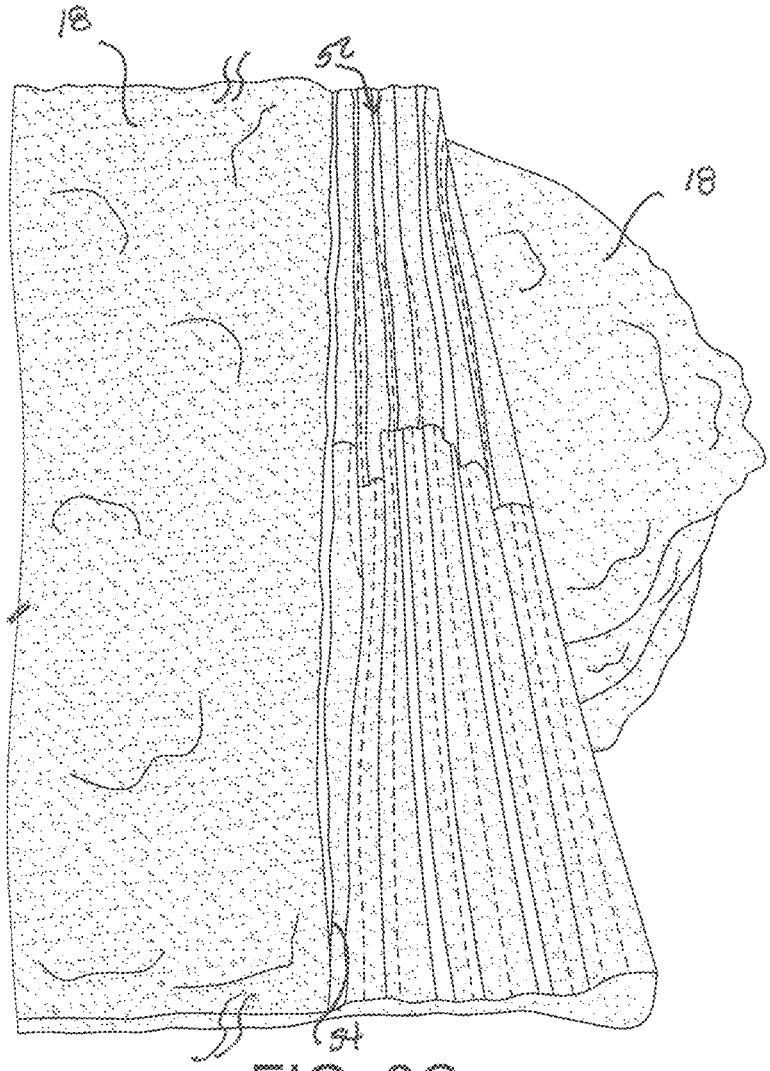
FIG. 3C is a detail perspective view of the embossed floor region of FIG. 3A.
Figure 4:
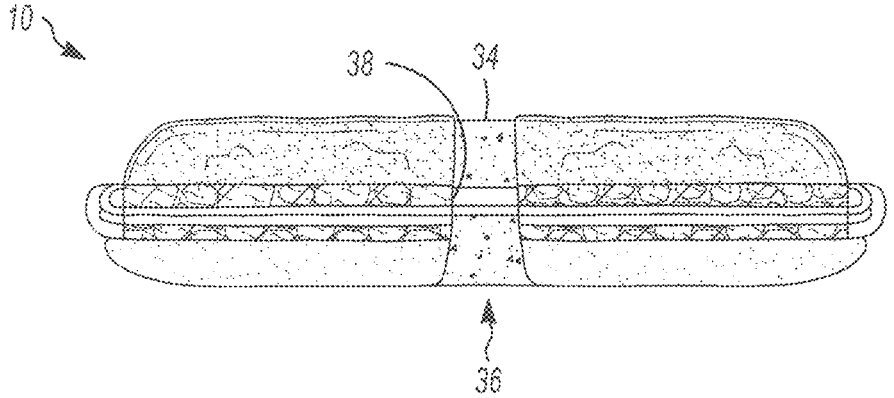
FIG. 4 is a cross-sectional view of the floor cleaning pad as disclosed herein taken along the 4-4 line of FIG. 1

The floor member 50 is depicted in cross section in FIG. 3A. Where desired or required, the floor member 50 can have a suitable surface topography configured to enhance contact between the floor region and the insert. The surface topography can include one or more ridges. In FIGS. 3A and 3B, the ridges are a plurality of parallelly grooves with a plurality if scam dashes.

In embodiments where the loft material in the loft material layer 218 is bonded to a suitable polymeric foam material interposed between support layer and the loft material. The foam material can be a layer that extends over the support layer 212. In certain embodiments, the press welding step can impart compression of the loft material with little or no compression of the interposed foam material.

The floor cleaning pad and/or the floor cleaning assembly as disclosed herein can be employed to accomplish floor cleaning and/or burnishing operations. It has been found, quite unexpectedly, that the floor cleaning pad such as floor cleaning pad 10,10', 210 and/or the floor cleaning assembly 200 as disclosed herein can achieve enhanced cleaning operations. Without being bound to any theory, it is believed that the configuration of the floor cleaning pad as disclosed herein having at least one agitator strip 34, 234 can accomplish more effective removal of surface dirt and/or can capture greater quantities generated during floor cleaning or burnishing operations.

Figure 21A:
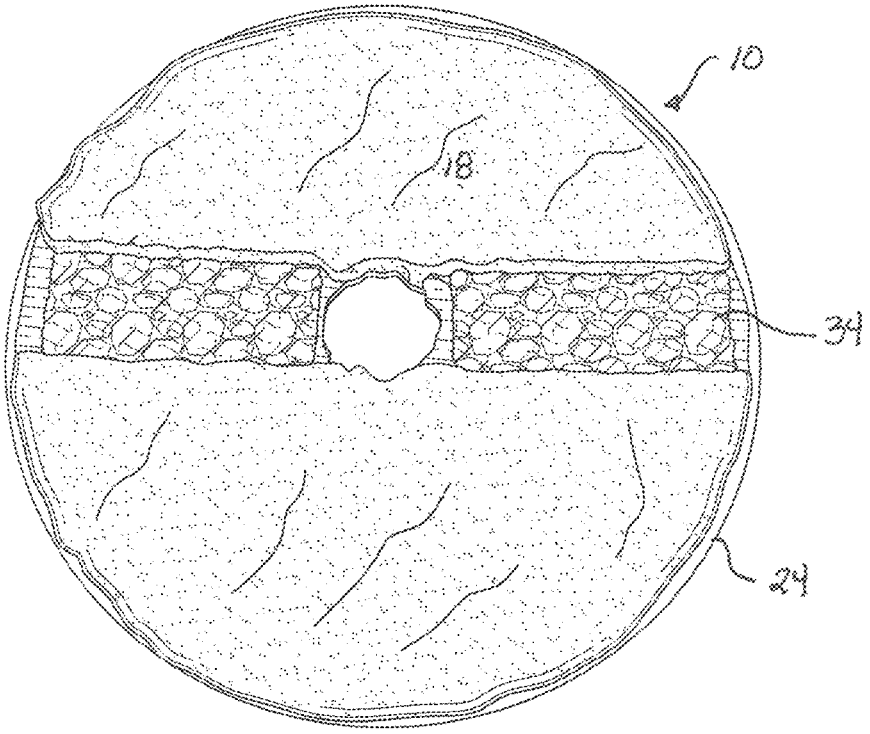
FIG. 21A is a top view of the floor cleaning pad according to the embodiment as depicted in FIG. 1 before floor cleaning operations.
Figure 21B:
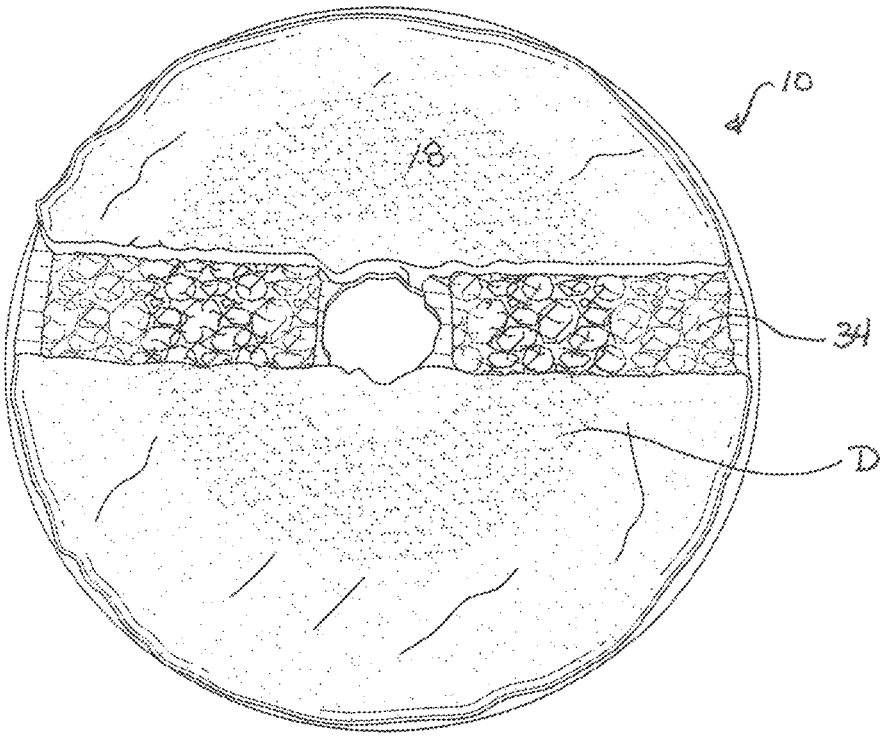
FIG. 21B is a top view of the floor cleaning pad according to the embodiment as depicted in FIG. 1 and after floor cleaning operations.

Cleaning operations are performed on a rubber floor using a cleaning pad 10 configured according to an embodiment as disclosed herein as illustrated in FIG. 21A. The floor cleaning operations are performed at 150 rpm using an auto scrubber configured with a vacuum apparatus drawing dirt through water over a 600 square foot region having a normal soil load imparted by normal foot traffic. After cleaning operations, the floor cleaning pad surface 18 is inspected, and the cleaning pattern D as illustrated in FIG. 21B is observed. The cleaning pattern D deposited on the surface of the loft material layer indicates that the pair of agitator strips embedded in the loft material layer dislodges surface dirt from adhesion to the floor surface, a portion of which is captured and entrained in the loft material.

In order to assess the effectiveness of cleaning operations of the floor cleaning pad 10 as disclosed herein, a floor cleaning pad configured with the same elements other than the agitator strips is employed a region of the rubber floor similar to the one tested. The floor cleaning operations are performed at 150 rpm using an auto scrubber configured with a vacuum apparatus drawing dirt through water over a 600 square foot region having a normal soil load imparted by normal foot traffic. The floor cleaning pad surface is inspected after the cleaning operations are completed showing less entrainment of dirt particles in the loft material.

Figure 21C:
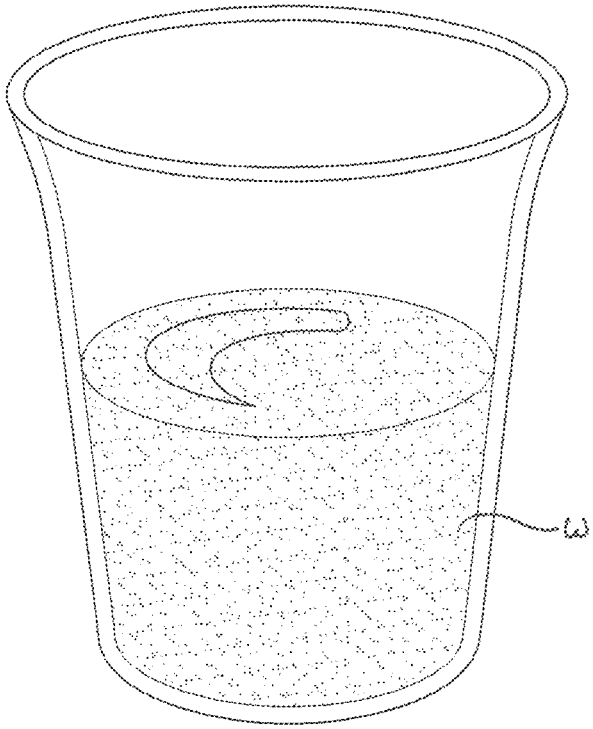
FIG. 21C is a side view of a beaker containing water-entrained dirt collected by floor cleaning operations using a floor cleaning pad of FIG. 21A.
Figure 21D:
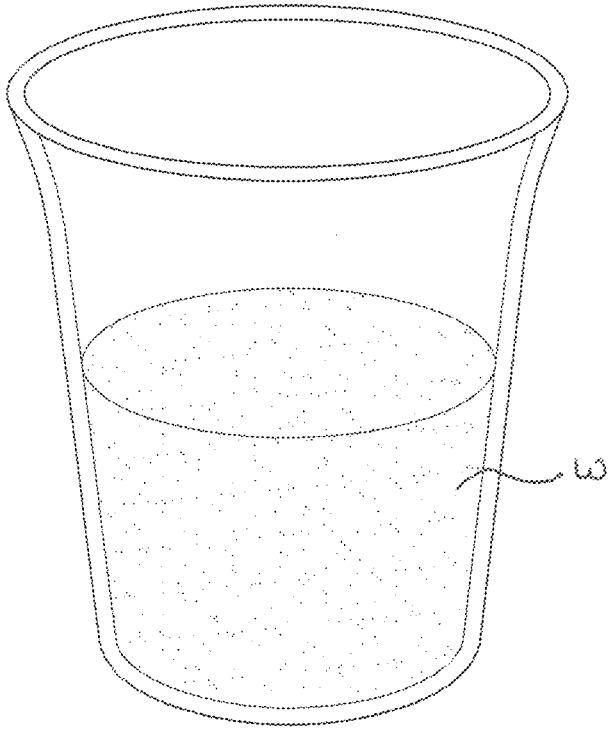
FIG. 21D is a side view of a beaker containing water-entrained dirt collected by a floor cleaning pad composed of a loft material layer only.

The water W collected in the respective cleaning operations is inspected visually. The results are similar to those illustrated in FIGS. 21C and 21D. The water entrained dirt contained in the water collected during cleaning operation s using the floor cleaning pad 10 as disclosed herein illustrated in FIG. 21C is at least 25% greater than that collected during cleaning operations with a floor cleaning pad that does not include the agitator region.

Figure 22:
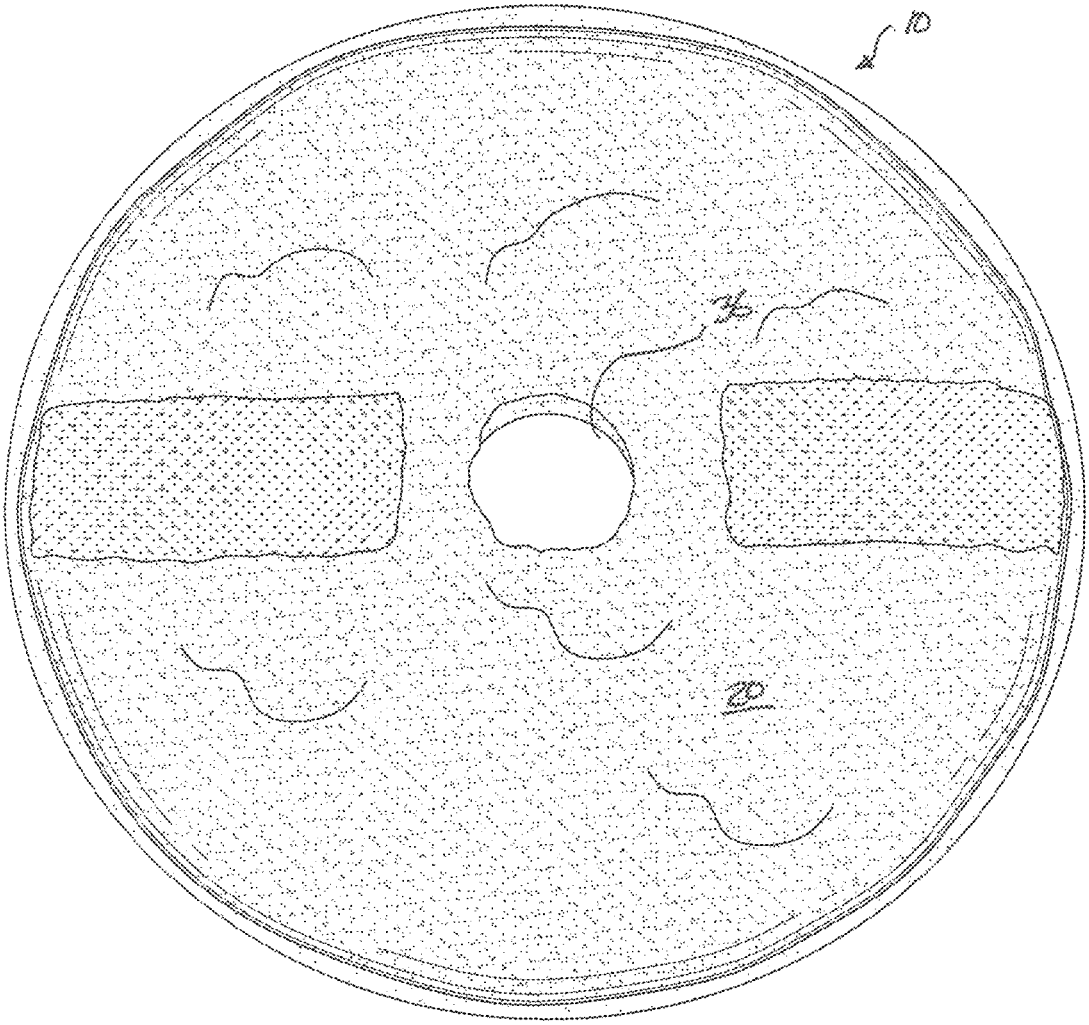
FIG. 22 is a top plan view of a fifth embodiment of the floor cleaning pad as disclosed herein.

Also disclosed are additional embodiments of the floor cleaning pad as outlined previously as illustrated in FIG. 22. The floor cleaning pad 10 has an outwardly oriented surface 20 that functions as a floor surface contacting face. The floor cleaning pad 10 includes a support layer (not shown), a loft material region 18 and an agitator region 34 overlying a portion of the support layer and connected thereto. The loft material region 18 comprises between 5% and 95% of the floor surface contacting face. In certain embodiments, the loft material region can compose between 50% and 95%; between 60% and 95%; between 70% and 95%; between 80% and 95%; between 90% and 95%; between 50% and 90%; between 60% and 90%; between 70% and 90%; between 80% and 90%; between 85% and 90%; between 50% and 80%; between 60% and 80%; between 70% and 80%; between 75 and % and 80%; between 50% and 70% %; between 60% and 70%. In certain embodiments, the remaining portion of the floor surface contacting face will be composed of the agitator region 34.

In certain embodiment, it is contemplated that the loft material region can comprise between 5 and 50% of the floor contacting surface face. In certain embodiments, the loft material region can compose between 10% and 50% of the floor contacting region; between 15% and 50%; between 20% and 50%; between 25% and 50%; between 30% and 50%; between 35% and 50%; between 40% and 50% between 45% and 50%; between 5% and 40%; between 10% and 40%; between 15% and 40%; between 20% and 40%; between 25% and 40%; between 30% and 40%; between 35% and 40%; 15% and 30%; between 20% and 30%; between 25% and 30%; 5% and 30%; between 10% and 30%; between 15% and 30%; between 5% and 20%; between 10% and 20%; between 15% and 20%. In certain embodiments, the remaining portion of the floor surface contacting face will be composed of the agitator region.

Where desired or required, the loft material region 18 and/or agitator region 34 can be composed of materials as previously described. The loft material region 18 can overlay the support material layer and be connected thereto. The loft material layer 18 can be composed of at least one loft material. The loft material layer can have a height $H_L$ and an outwardly facing surface.

Where desired or required, the loft material in the loft material region 18 can contain between 50% and 100% polyester fibers. In certain embodiments, 50 and 100% of the loft layer material layer can be composed of microfibers having a size less than 0.7 denier, the loft material has a height $H_L$.

The support layer can be a polymeric substrate is at least one of polymeric foam, a woven fiber backing member, a non-woven backing and the like.

In the specific embodiment, agitator region 34 overlays at least a portion of the support material layer and is connected thereto. Where desired or required, the agitator region 34 can have a height $H_A$ and an outwardly facing surface. Where desired or required, the agitator region 34 can be composed of a synthetic pile fabric having pile elements having a height $H_P$ less than or equal to the height $H_L$ of the microfiber loft material. The synthetic pile fabric of the agitator region 34 can be composed of cut pile fibers, loop pile fibers or mixtures thereof. In certain embodiments, the pile fibers of the synthetic pile fabric of the agitator region can be composed of monofilaments extruded from a material that includes at least one of the following polyamides, polyesters, polyethylene, vinyl-vinylidene chloride, polyvinyl chloride, polyacrylonitrile, cellulose acetate, cellulose triacetate, rayon, glass and the like. These fibers can include extruded monofilaments of between 300 and 120 denier, wherein the monofilaments are configured as monofilament ribbons.

Where desired the lessor region can be configured in a desired geometric configuration and can be bounded, at least in part, by the material that constitutes the greater region. In the embodiment depicted in FIG. 22, the minor region is configured as an elongated strip that bisects a circularly configured floor cleaning pad 10 at a position that includes a central through aperture 36. In certain embodiments, the width of the strip can be equal to or less than the diameter of the though aperture 36. In certain embodiments, the elongated strip can be composed of the agitator material. It is also within the purview of the present disclosure that the strip can be composed of loft material and the surrounding material can be agitator material. Non-limiting examples of suitable dimensions can include a strip between 2 and 5 inches in circular floor cleaning pads with a diameter between 15 and 25 inches.

Figure 23:
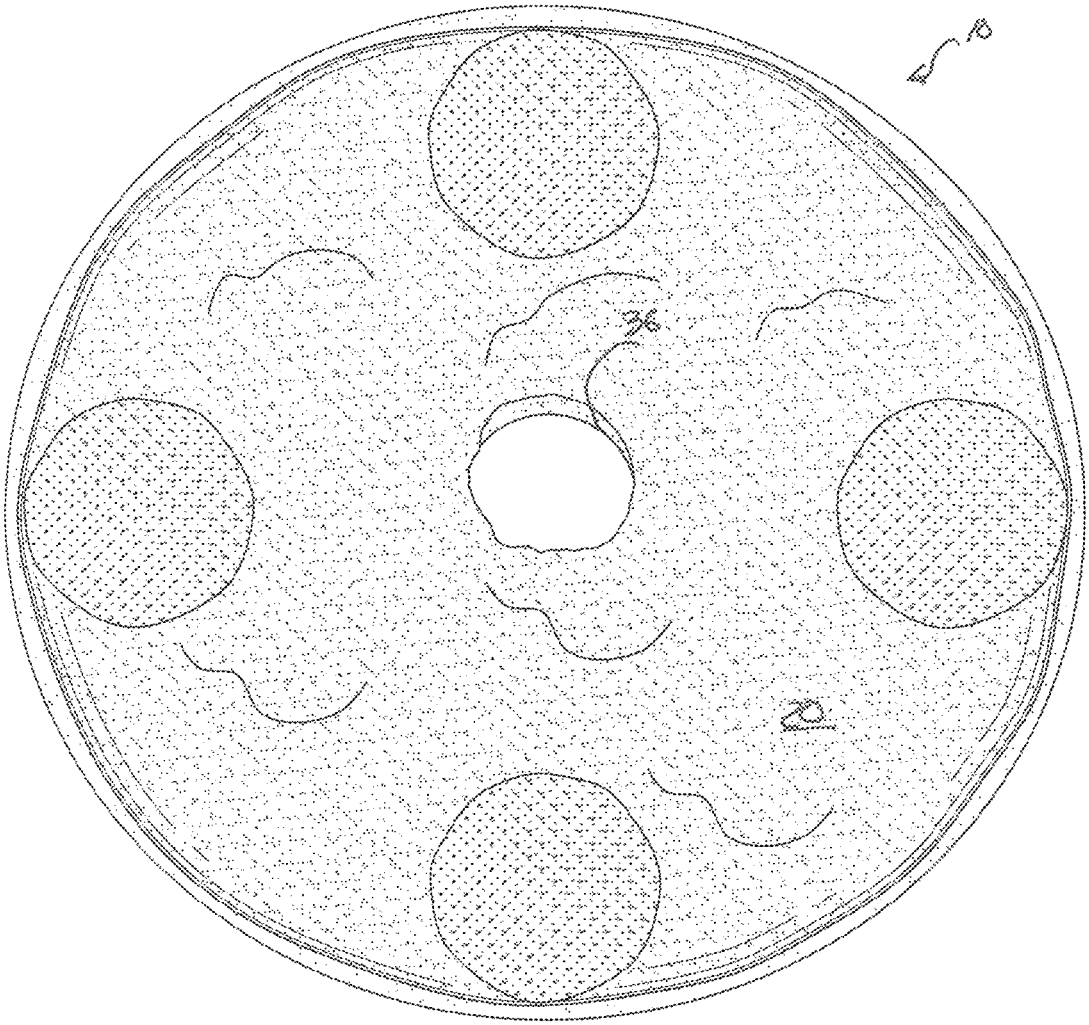
FIG. 23 is a top plan view of a sixth embodiment of the floor cleaning pad as disclosed herein.

It is also within the purview of the present disclosure for floor clearing pad 10 include one or more discrete geometric bodies disposed in spaced relationship on the face 20 of the floor cleaning pad 10. One non-limiting example has a plurality of circular regions are disposed in spaced relationship on the floor contacting surface face of the floor cleaning pad. The number of circular regions can be greater than two and in certain configurations, ca be greater than three. In the embodiment depicted in FIG. 23, four circular regions are disposed in spaced relationship on the floor contacting surface. Where desired or required, the circular regions can be disposed in the region proximate to the outer periphery of the floor cleaning pad. In certain embodiments, the circular regions can be in abutting relationship with the outer periphery.

The circular regions have a total area that is equivalent to the values of the minor regions as defined previously.

Figure 24:
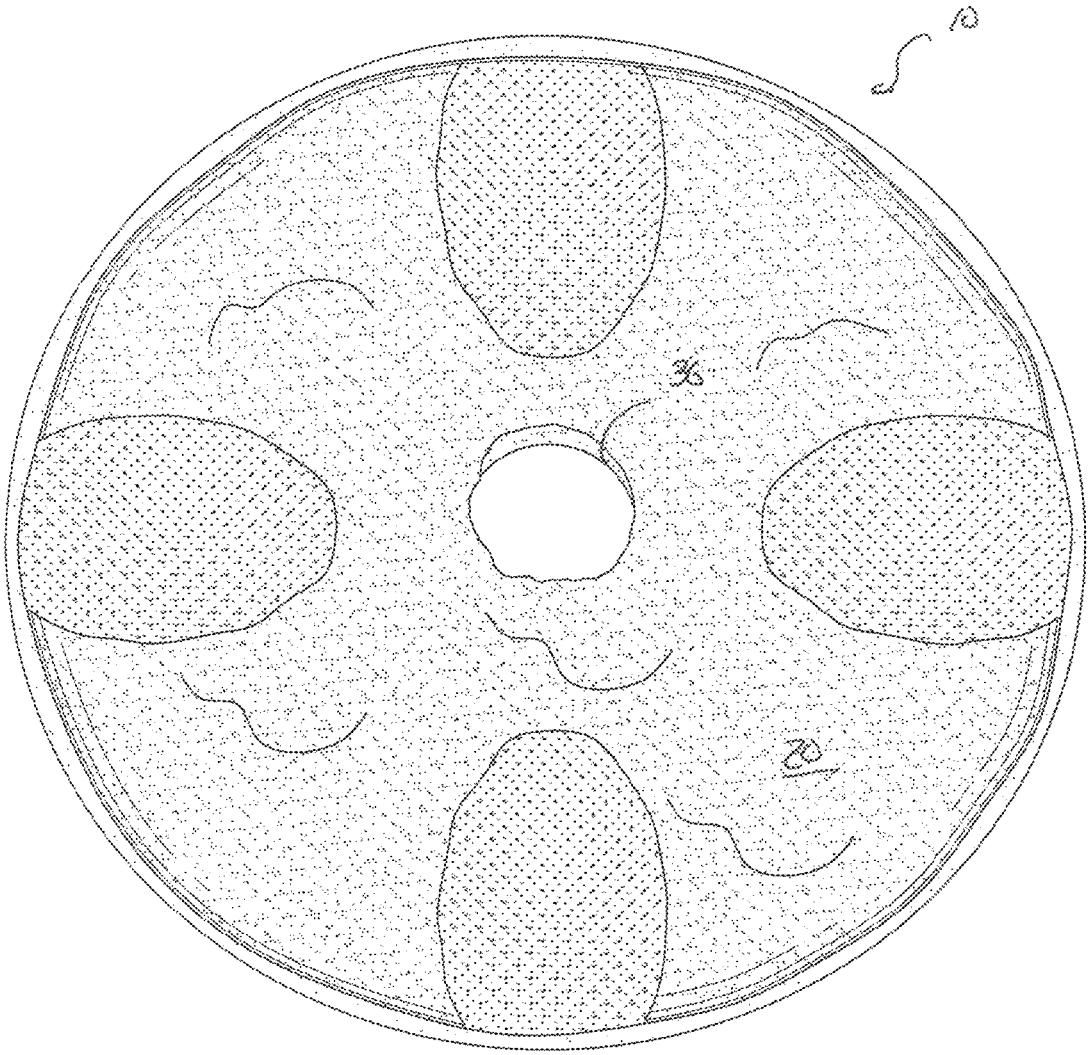
FIG. 24 is a top plan view of a seventh embodiment of the floor cleaning pad as disclosed herein.

In certain embodiments, the minor region can be configured as one or more oval regions. In the embodiment depicted in FIG. 24, a plurality of truncated oval regions are disposed around the periphery of the circular floor cleaning pad illustrated. The truncated ovals have a total surface area as previously outlined. In certain embodiments, the total surface area can be between 20% and 40%.

Figure 25:
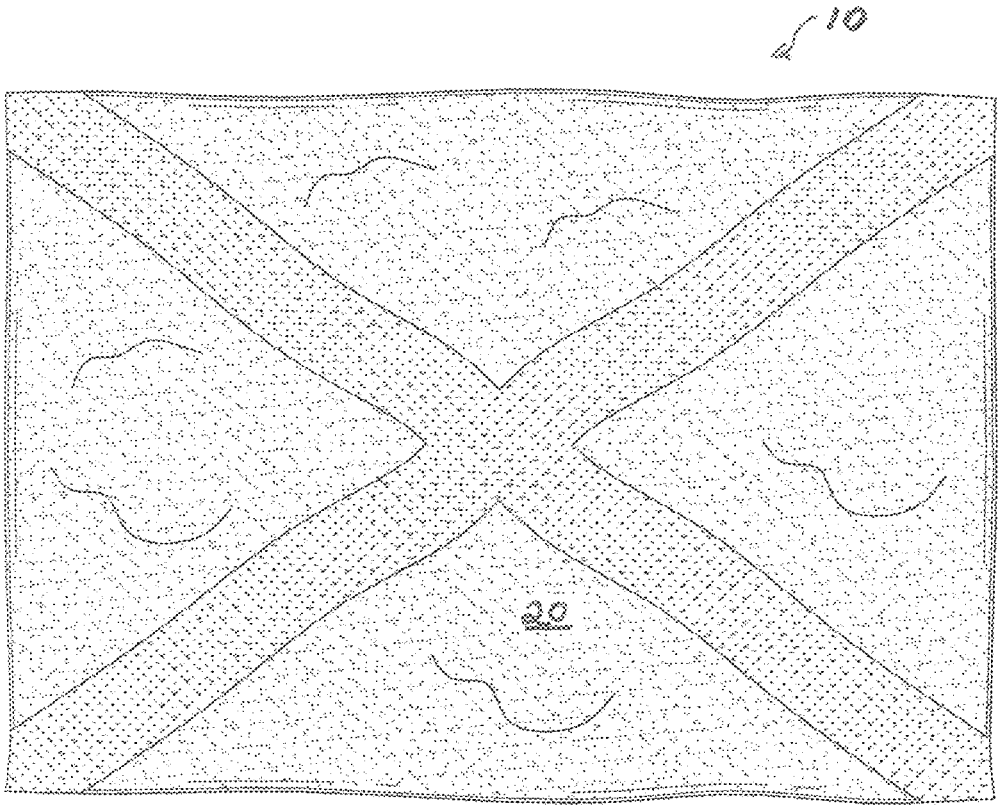
FIG. 25 is a top plan view of an eighth embodiment of the floor cleaning pad as disclosed herein.
Figure 26:
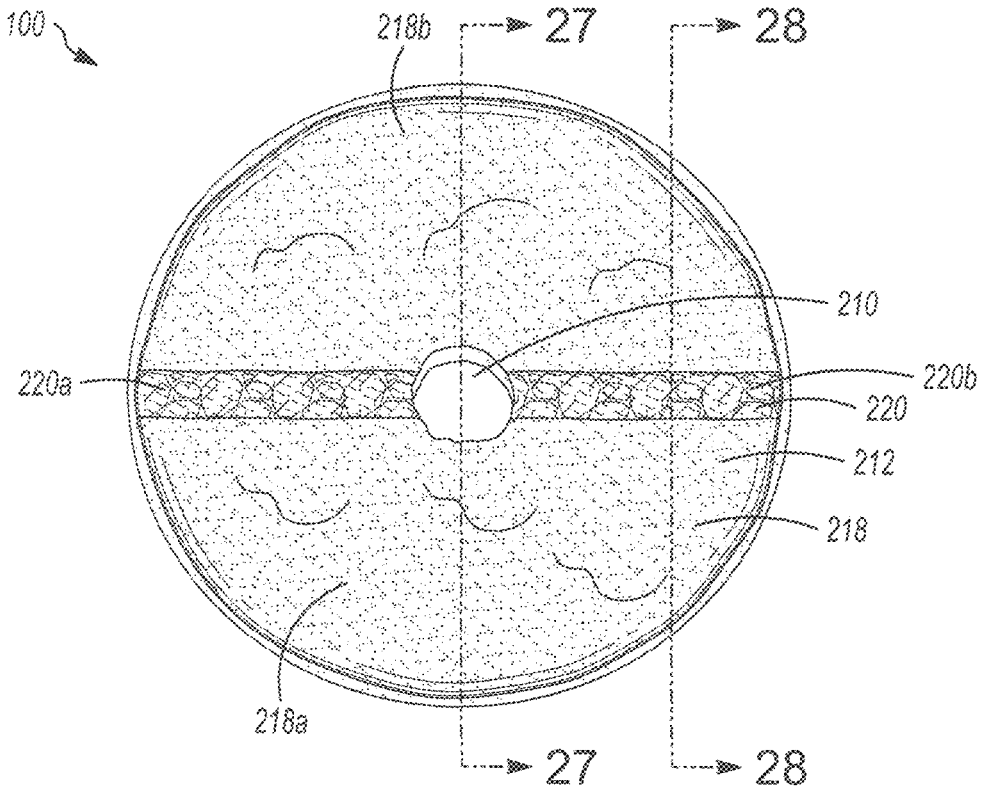
FIG. 26 is a perspective view of an embodiment of a floor pad that can be used in floor refurbishment operations.
Figure 27:
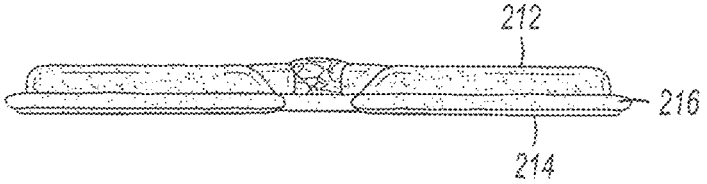
FIG. 27 is a cross-sectional view of the embodiment of FIG. 26 taken through the 27-27 line.
Figure 28:
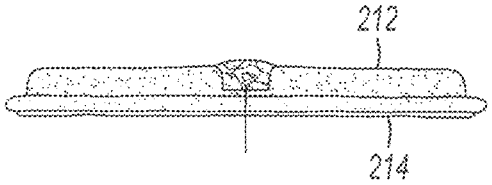
FIG. 28 is a is a cross-sectional view of the embodiment of FIG. 26 taken through the 28-28 line; 1.

In certain embodiments, the minor areas can contact one another. A non-limiting example of such configuration is illustrated in FIG. 25 where two elongated strips bisect one another in a rectangularly configured floor cleaning pad.

Where desired or required, in certain embodiments, the loft material region can comprise between 50 and 95% of the floor surface contacting face. The minority portion of the floor contacting face can be composed of agitator region material as discussed previously. It is contemplated that such configurations can be effectively employed to accomplish cleaning operations and maintain protective floor coatings if desired or required. Where desired or required, the agitator region or regions can be configured in any suitable geometric shape or combination of shapes. Non-limiting examples can include as one or more elongated strips, as ovals, circles, squares etc. within the major loft material portion. In certain configurations, the agitator region can be configured as at least two discrete regions in spaced relationship on the floor cleaning surface of the floor cleaning pad. In certain configurations, the loft material region can comprise between 80 and 95% of the floor cleaning surface of the floor cleaning pad; between 70 and 95%; between 60 and 95%; between 50 and 90%; between 60 and 90%; between 70 and 90%; between 80 and 90%.

In certain embodiments, the floor cleaning pad has a floor surface contacting face and can include a support layer that has a central region and an outer peripheral edge that defines an outer support layer dimension. The floor cleaning pad can also have a loft material region overlaying the support material layer and connected thereto, the loft material can be composed of at least one loft material. The loft material layer can have a height $H_L$ as well as an outwardly facing surface. The floor cleaning pad can also include an agitator region overlaying a portion of the support material layer and connected thereto that has a height $H_A$ and an outwardly facing surface with the loft material region comprising between 5% and 95%; between 5 and 50%; between 10 and 25%; between 80 and 90%, of the floor surface contacting face. The loft material in the loft material layer can contain between 50% and 100% polyester fibers with between the 50 and 100% of the loft layer material layer being composed of microfibers having a size less than 0.7 denier, the loft material can have a height $H_L$. Where desired or required the support layer is a polymeric substrate is at least one of polymeric foam, a woven fiber backing member, a non-woven backing. It is contemplated that the agitator region can be composed of a synthetic pile fabric in which pile elements have a height $H_P$ less than or equal to the height $H_L$ of the microfiber loft material. The synthetic pile fabric of the agitator region is composed of cut pile fibers, loop pile fibers or mixtures thereof. In certain embodiments, the pile fibers of the synthetic pile fabric of the agitator region can be composed of monofilaments extruded from a material that includes at least one of the following polyamides, polyesters, polyethylene, vinyl-vinylidene chloride, polyvinyl chloride, polyacrylonitrile, cellulose acetate, cellulose triacetate, rayon, glass and the like and can, optionally, include extruded monofilaments of between 300 and 120 denier, with the monofilaments are configured as monofilament ribbons.

Where desired the agitator region can be configured as one or more discrete regions configured as ovals, elongated strips circles of the like. In certain embodiments, the agitator region can be configured as at least two discrete regions in spaced relationship to one another on the floor cleaning surface of the floor cleaning pad.

In other embodiments, it is contemplated that the loft material region can comprise between 5% and 50% of the floor surface contacting face of the floor pad. Where desired or required, the major portion of the floor facing surface of the floor pad can be composed of agitator region material as discussed previously. It is also contemplated that in such embodiments, the major portion of the floor cleaning surface can be configured to enhance the abrasive nature of the material in the major portion to provide and abrasive region and that is sufficient to assist in the refurbishment of the desired floor surface. Refurbishment can include, but is not limited to, operations such as stripping, burnishing that the like. Such processes can include the removal of one or more floor coating layers. Such processes can include certain polishing processes.

Where desired or required, the agitator regions with enhanced abrasive characteristics can be connected to regions of compressed loft material as described previously. It is also contemplated that a floor refinishing pad as disclosed herein can be comprised of at least one support layer. The support layer has at least one abrasive material region affixed thereto. Where desired or required, the support can have two or more abrasive regions that are connected to the at least one support layer by any suitable means or mechanism. The attachment means or mechanism will be one that provides secure connection between the members during oscillations and or rotation, preferably over a plurality of duty cycles. Non-limiting examples of attachment means or mechanisms laser welding, stitching, adhesive bonding and the like.

In certain embodiments, the one or more abrasive regions can be attached directly to the support layer. In certain embodiments, one or more intermediate layers can be interposed between the support layer and the lower face of the abrasive region. The intermediate layer or layers can be composed of one or more materials chosen to impart suitable characteristics to the associated floor pad. Non-limiting examples of suitable characteristics can include strength, flexibility, compressibility and the like.

The various abrasive region(s) can be composed of one or more abrasive materials having abrasive characteristics suitable for removing some or all of coating material overlying a floor surface. In some embodiments, the abrasive region can be configured and can contain material as previously described. Where desired or required, some or all of the fibers in the abrasive region can be composed of material having greater stiffness that that employed in the agitator strips or agitator regions previously described.

The floor pad for refurbishing or restoring a floor surface also includes at least one loft material region that overlays the support layer in abutting relationship with the at least one abrasive region. The at least one loft material region forms can constitute a minor amount of the area of the floor contacting surface of the associated floor pad.

Also disclosed is a floor cleaning assembly that includes one of the pads as disclosed herein and a floor cleaning machine that includes a housing, at least one motor operatively mounted in the housing, and at least one actuator operatively connected to the motor the at least one actuator configured to impart at least one of rotational movement, oscillating movement, rotational and oscillating movement to at least one output device, the output device having at least one attachment mechanism. In general the floor cleaning pad can include a support layer having a central region and an outer peripheral edge defining an outer support layer dimension, a loft material layer, overlaying the support material layer and connected thereto, the loft material composed of at least one polymeric fiber loft material and the loft material layer having a height $H_L$ and an outwardly facing surface and at least one agitator strip overlaying a portion of the support material layer and connected thereto, the agitator strip having a height $H_A$ and an outwardly facing surface such that the outwardly facing surface of the agitator strip is at an orientation planar with or indented relative to the outer face of the loft material layer and the support layer is releasably connected to the at least one attachment mechanism on the output device of the floor cleaning machine. It is contemplated that the actuator device of the floor cleaning machine can impart rotational movement to the floor cleaning to the removable floor cleaning pad about a central axis, the rotational movement being between 100 rpm and 2500 rpm. The floor cleaning pad can have either a circular or rectilinear outer periphery that corresponds to an associated boundary defined by the associated floor cleaning machine. Where desired or required, the agitato strip extends from a region proximate to the outer periphery to a point inward on the cleaning pad. Depending on the type of floor treatment desired, the floor cleaning machine can impart either rotational movement to the floor pad relative to the floor surface at a rate between 100 and 2500 rpm or greater or rotational and oscillation movement about a central axis between 1700 rpm and 3600 rpm and between 1000 and 2500 oscillations per minute.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A floor cleaning pad comprising:

a support layer, the support layer having a central region, a first support layer face and a second support layer face opposed to the first support layer face, and an outer peripheral edge defining an outer support layer dimension, wherein the outer support layer dimension is either circular or rectilinear;

a first microfiber loft material region overlaying the first support layer face of the support layer and connected thereto, the first loft material region having a first microfiber loft material layer dimension less than or equal to the outer support layer dimension, the first microfiber loft material region having a height $H_L$ and an outwardly facing surface;

a second microfiber loft material region overlaying the second support layer face of the support layer and connected thereto, the second microfiber loft material region having a second microfiber loft material region dimension less than or equal to the outer support layer dimension, the second microfiber loft material region having a height $H_L$ and an outwardly facing second microfiber loft material region surface;

a first agitator region overlaying a portion of the first support layer face of the support layer and connected thereto, the first agitator region having a height $H_A$ and an outwardly facing agitator region surface; and a second agitator region overlaying a portion of the second support layer face of the support layer and connected thereto, the second agitator region having a height $H_A$ and an outwardly facing surface, wherein the second agitator region extends inward from the outer peripheral edge defined by the support layer, wherein the outwardly facing surface of the first agitator region is at an orientation planar with or indented relative to the outer face of the first loft material and wherein the first agitator region extends inward from the outer peripheral edge defined by the support layer, wherein the outwardly facing surface of the second agitator region is at an orientation planar with or indented relative to the outer face of the second loft material and wherein the second agitator region extends inward from the outer peripheral edge defined by the support layer, wherein at least one of the first microfiber loft material layer and the second loft microfiber material layer comprise randomly oriented microfibers, and wherein the second agitator region is connected to the support layer at a location that does not overlay to the first agitator region.

2. The floor cleaning pad of claim 1, wherein microfiber loft material in at least one of the first microfiber loft material layer and the second microfiber loft material layer contains between 50% and 100% polyester fibers and wherein 50% and 100% of the microfiber loft layer material layer is composed of microfibers having a value less than 0.7 denier.

3. The floor cleaning pad of claim 1, wherein at least one of the first agitator region and the second agitator region is composed of a synthetic pile fabric, the synthetic pile fabric having pile elements having a height less than or equal to the height of the microfiber loft material connected to the first face of the support layer, wherein the synthetic pile fabric of the first agitator region is composed of cut pile fibers, loop pile fibers or mixtures thereof and wherein at least one of the first agitator region and the second agitator region is composed of monofilaments composed of at least one material as follows polyamides, polyesters, polyethylene, vinyl-vinylidene chloride, polyvinyl chloride, polyacrylonitrile, cellulose acetate, cellulose triacetate, rayon, glass and mixtures thereof.

4. The floor cleaning pad of claim 3, wherein the synthetic pile fabric of the first agitator region and the second agitator region include extruded monofilaments of between 300 and 1200 denier, wherein the monofilaments are configured as monofilament ribbons.

5. The floor cleaning pad of claim 4, wherein the support layer is a polymeric substrate of at least one of polymeric foam, a woven fiber backing member, a non-woven backing.

6. The floor cleaning pad of claim 5, wherein the support layer of the first agitator region and the second agitator region is positioned in a detent defined in the support layer of the floor cleaning pad.

7. A floor cleaning assembly comprising:

a floor cleaning machine including:

a housing;

at least one motor operatively mounted in the housing;

at least one actuator operatively connected to the motor, the at least one actuator configured to impart at least one of rotational movement, oscillating movement, and rotational and oscillating movement to at least one output device, the output device having at least one attachment mechanism; and the floor cleaning pad of claim 1.

8. A floor cleaning pad comprising:

a support layer, the support layer having a central region, a first support layer face and a second support layer face opposed to the first support layer face, and an outer peripheral edge defining an outer support layer dimension, wherein the outer support layer dimension is either circular or rectilinear;

a first microfiber loft material region overlaying the first support layer face of the support layer and connected thereto, the first microfiber loft material region having a first microfiber loft material region dimension less than or equal to the outer support layer dimension, the first microfiber loft material region having a height $H_L$ and an outwardly facing first microfiber loft material region surface;

a second microfiber loft material region overlaying the second support layer face of the support layer and connected thereto, the second microfiber loft material region having a second microfiber loft material region dimension less than or equal to the outer support layer dimension, the second microfiber loft material region having a height $H_L$ and an outwardly facing surface;

a first agitator region overlaying a portion of the first support region face of the support layer and connected thereto, the first agitator region having a height $H_A$ and an outwardly facing surface; and a second agitator region overlaying a portion of the second support layer face of the support layer and connected thereto, the second agitator region having a height $H_A$ and an outwardly facing surface;

wherein the outwardly facing surface of the first agitator region and the second agitator region are at an orientations planar with or indented relative to the outer face of a respective microfiber loft material and wherein the first agitator region and the second agitator region extend inward from the outer peripheral edge defined by the support layer, wherein at least one of the first microfiber loft material region and the second loft microfiber material region comprise randomly oriented microfibers, wherein the outer peripheral edge defines a circular boundary and wherein the first agitator region extends inward from the outer peripheral edge defined by the support layer and wherein the first agitator region comprises at least two axially opposed rectilinear strips, wherein the rectilinear strips of the first agitator region and the rectilinear strips of the second agitator region are each located in respective slots defined in the respective microfiber loft material layer.

9. The floor cleaning pad of claim 8, wherein the respective slots each include opposed wall members and a floor member, the floor member composed of compressed melt-bonded microfiber.

10. The floor cleaning pad of claim 8, wherein compressed melt-bonded microfibers present in the floor cleaning pad extend into microfiber loft material present in the first microfiber loft material region or the second microfiber loft material region.

* * * * *